US010455943B2

(12) United States Patent
Wallace et al.

(10) Patent No.: US 10,455,943 B2
(45) Date of Patent: Oct. 29, 2019

(54) THEMED STOOL

(71) Applicants: James Wallace, Gurnee, IL (US); Yudel Marcelo Martinez Reyna, Oak Park, IL (US); Horace Cesar Rodriguez, Schaumburg, IL (US)

(72) Inventors: James Wallace, Gurnee, IL (US); Yudel Marcelo Martinez Reyna, Oak Park, IL (US); Horace Cesar Rodriguez, Schaumburg, IL (US)

( * ) Notice: Subject to any disclaimer, the term of this patent is extended or adjusted under 35 U.S.C. 154(b) by 46 days.

(21) Appl. No.: 15/688,290

(22) Filed: Aug. 28, 2017

(65) Prior Publication Data

US 2019/0059596 A1 Feb. 28, 2019

(51) Int. Cl.

| | |
|---|---|
| ***A47C 7/50*** | (2006.01) |
| ***A47C 7/00*** | (2006.01) |
| ***A47C 7/72*** | (2006.01) |
| ***A47C 7/02*** | (2006.01) |
| ***G09F 23/06*** | (2006.01) |
| ***A47C 7/62*** | (2006.01) |
| ***A47C 9/00*** | (2006.01) |
| *A47B 91/00* | (2006.01) |
| *G09F 23/00* | (2006.01) |

(52) U.S. Cl.

CPC ..... *A47C 7/004* (2013.01); *A47C 7/029* (2018.08); *A47C 7/50* (2013.01); *A47C 7/62* (2013.01); *A47C 7/72* (2013.01); *A47C 9/007* (2013.01); *G09F 23/06* (2013.01); *A47B 91/00* (2013.01); *G09F 2023/005* (2013.01)

(58) Field of Classification Search

CPC ..... A47C 3/18; A47C 9/007; A47C 7/004; A47C 7/029; A47C 7/50; A47C 7/72; A47C 7/725; A47B 91/00; G09F 7/18; G09F 15/0037; G09F 15/0018

See application file for complete search history.

(56) References Cited

U.S. PATENT DOCUMENTS

| | | | | | |
|---|---|---|---|---|---|
| 1,786,883 | A * | 12/1930 | Zahonyi | G09F 7/18 | 248/230.5 |
| 2,010,306 | A * | 8/1935 | Leech | A47C 3/285 | 108/139 |
| 2,542,480 | A * | 2/1951 | Cramer | A47C 3/26 | 248/408 |
| 2,708,965 | A * | 5/1955 | King | A47C 5/00 | 297/461 |

(Continued)

*Primary Examiner* — Shin H Kim

(74) *Attorney, Agent, or Firm* — Mercedes V. O'Connor; Howard B. Rockman; Rockman Videbeck & O'Connor

(57) ABSTRACT

A themed stool that includes a seat, a mainframe component supporting the seat, an inner shaft disposed within the mainframe component, a lower shaft that receives the inner shaft, and a removable base to the lower shaft. The themed stool also includes a mounting bracket assembly that removably attached a three dimensional ornamental figure, a silhouette of a themed figure, or a decorative graphic to the mainframe component of the stool. The mounting bracket assembly can also be removably attached to any stool. The mounting bracket assembly includes a mounting bracket removably attached to one of the three dimensional ornamental figure and the silhouette of a themed figure and at least one attachment bracket that removably attaches the mounting bracket assembly to the shaft of any stool.

20 Claims, 33 Drawing Sheets

(56) References Cited

U.S. PATENT DOCUMENTS 2,850,077 A * 9/1958 Dawson ..... A47C 9/022 248/414
2,998,979 A * 9/1961 Sandell ..... B62B 5/082 280/42
3,278,229 A * 10/1966 Bates ..... A47C 3/18 248/407
3,724,745 A * 4/1973 Brown ..... A47C 9/007 206/216
D233,381 S * 10/1974 Wright ..... D6/351
3,843,197 A * 10/1974 Wright ..... A47C 3/18 248/425
3,891,270 A * 6/1975 Crossman ..... A47C 3/30 248/404
4,085,983 A * 4/1978 Johnson ..... A47C 3/18 16/20
4,148,524 A * 4/1979 Guyton ..... A47C 7/506 248/188.5
4,208,072 A * 6/1980 Iskendarian ..... A47C 3/04 108/150
D279,430 S * 7/1985 McLeroy ..... D6/358
D292,147 S * 10/1987 Lomedico ..... D6/349
4,929,021 A * 5/1990 Kaye ..... A47C 7/725 108/150
D311,760 S * 10/1990 Harrod ..... D21/433
5,088,672 A * 2/1992 Neuendorf ..... F16B 2/06 248/218.4
D330,736 S * 11/1992 Silber ..... D21/433
5,297,849 A * 3/1994 Chancellor ..... A47C 3/18 297/344.12
5,330,210 A * 7/1994 Lambrecht ..... B62B 3/144 280/33.993
5,749,557 A * 5/1998 Chang ..... A47C 3/18 248/405
5,882,076 A * 3/1999 Garelick ..... A47C 3/18 248/411
6,003,944 A * 12/1999 Glockl ..... A47C 3/18 297/313
6,116,682 A * 9/2000 Baur ..... A47C 3/12 297/118
6,381,890 B1 * 5/2002 Sjostedt ..... G09F 3/08 248/206.5
D486,313 S * 2/2004 Manzali ..... D6/360
D487,982 S * 4/2004 Lee ..... A47C 9/007 D6/360
D489,911 S * 5/2004 Muller ..... D6/360
6,829,853 B2 * 12/2004 Kim ..... G09F 7/18 248/214
6,839,996 B2 * 1/2005 Kim ..... G09F 7/18 248/214
6,880,279 B2 * 4/2005 Kim ..... G09F 7/22 40/607.12
6,971,199 B2 * 12/2005 Kim ..... G09F 7/22 40/607.12
6,976,660 B2 * 12/2005 Lapointe ..... G09F 7/18 248/218.4
7,219,956 B2 * 5/2007 Zhang ..... A47B 91/00 297/195.11
7,303,237 B1 * 12/2007 Hughes ..... B60N 2/882 297/391
D579,677 S * 11/2008 Zhou ..... D6/349
7,722,123 B2 * 5/2010 Holland ..... A47B 13/023 297/423.1
D647,713 S * 11/2011 Unterrainer ..... D6/349
8,177,297 B2 * 5/2012 Powell ..... A47D 1/008 297/148
8,234,805 B2 * 8/2012 Dukes ..... G09F 7/18 248/206.5
D668,464 S * 10/2012 Du ..... D6/353
8,303,041 B2 * 11/2012 Gasser ..... A47C 7/002 248/163.1
8,459,736 B1 * 6/2013 Begley, Jr. ..... A47C 1/0265 297/217.7
8,534,685 B1 * 9/2013 Tohm, Sr. ..... B60B 33/08 280/87.021
D697,329 S * 1/2014 Kuo ..... D6/358
8,657,374 B2 * 2/2014 Higgs ..... A47C 3/04 297/239
8,935,870 B2 * 1/2015 Dent ..... G09F 7/18 40/607.12
D746,073 S * 12/2015 Elmaleh ..... D6/349
D748,924 S * 2/2016 Walser ..... D6/352
D799,229 S * 10/2017 Pan ..... D6/364
D801,064 S * 10/2017 Von Boetticher ..... D6/352
9,927,063 B2 * 3/2018 Keller ..... F16M 13/02
2003/0213153 A1 * 11/2003 Kim ..... G09F 7/18 40/607.14
2005/0076553 A1 * 4/2005 Kim ..... G09F 7/22 40/607.12
2005/0097802 A1 * 5/2005 Kim ..... G09F 7/22 40/791
2007/0170754 A1 * 7/2007 Kang ..... A47C 3/18 297/218.1
2007/0290541 A1 * 12/2007 Tsai ..... A47C 7/52 297/423.1
2008/0250686 A1 * 10/2008 Lee ..... G09F 15/0081 40/606.09
2010/0218408 A1 * 9/2010 Holland ..... A47B 13/023 40/606.08
2010/0276900 A1 * 11/2010 Giannini ..... B62B 3/144 280/33.993
2011/0277363 A1 * 11/2011 Dukes ..... G09F 7/18 40/606.01
2012/0267929 A1 * 10/2012 Donley ..... A47C 4/03 297/311
2013/0049412 A1 * 2/2013 Fisher ..... A47C 3/16 297/135
2018/0279792 A1 * 10/2018 Casilio ..... A47B 13/08

* cited by examiner

SECTION A-A

SECTION B-B

SECTION A-A

DETAIL C
SCALE 1 : 5

DETAIL B
SCALE 1 : 5

SECTION A-A
SCALE 1 : 10

SECTION B-B
SCALE 1 : 10

DETAIL C
SCALE 1 : 5

SECTION A-A

SECTION B-B

SECTION A-A

SECTION B-B

SECTION C-C

SECTION B-B

SECTION A-A

SECTION B-B

SECTION A-A

SECTION B-B

SECTION A-A

THEMED STOOL

TECHNICAL FIELD

This disclosure relates to a themed stool, and more particularly, to themed bar stool.

BACKGROUND

Residential and commercial buildings furnish the interior of their buildings with various pieces of furniture. Residential homes may have a kitchen and/or bar area that includes stools. Commercial establishments may include a bar and/or high-top tables that include stools. Commercial establishments may want to promote a sport, a particular team, and/or a particular brand on their walls as well as on their bar stools. Homeowners that are particularly interested in a sport, particular team, or brand may also want to have a bar stool that includes figures and/or graphics of the theme they are interested in. Themed bar stools can include a silhouette of a themed figure and/or three dimensional ornamental figures. Additionally, the themed bar stool can include graphics on the base of the stool, on the attachment mechanism for the silhouette or three dimensional figure, and on the seat of the stool. The bar stool can also include lights, such as light emitting diode (LED) lights to highlight the figure, the graphics, or simply illuminate the bar stool itself and the area around where the bar stool is situated.

SUMMARY

This disclosure relates generally to a themed stool. One implementation of the teachings herein is a stool that includes a seat; a mainframe component comprising a planar surface adapted to support the seat; an inner shaft disposed within the mainframe component; a lower shaft adapted to receive a distal end of the inner shaft; and a base removably attached to the lower shaft.

One implementation of the teachings herein is a mounting bracket assembly that includes one of a three dimensional ornamental figure and a silhouette of a themed figure; a mounting bracket removably attached to one of the three dimensional ornamental figure and the silhouette of a themed figure; and at least one attachment bracket mounted to the mounting bracket, the attachment bracket adapted to removably attach the mounting bracket assembly to a shaft of a stool.

These and other aspects of the present disclosure are disclosed in the following detailed description of the embodiments, the appended claims and the accompanying figures.

BRIEF DESCRIPTION OF THE DRAWINGS

The various features, advantages, and other uses of the device and method will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 119 is a left side elevation view of the first embodiment of the stool, showing the prior art seat and the sixth embodiment of a three dimensional ornamental figure in accordance with implementations of this disclosure;

FIG. 120 is a rear elevation view of the first embodiment of the stool, showing the prior art seat and the sixth embodiment of a three dimensional ornamental figure in accordance with implementations of this disclosure;

FIG. 121 is a bottom elevation view of the first embodiment of the stool in accordance with implementations of this disclosure;

FIG. 122 is a top perspective view of the first embodiment of the stool, showing the prior art seat and the sixth embodiment of a three dimensional ornamental figure in accordance with implementations of this disclosure;

FIG. 123 is a front perspective view of the sixth embodiment of a three dimensional ornamental figure of the first embodiment of the stool with the prior art seat in accordance with implementations of this disclosure;

FIG. 124 is a rear elevation view of the sixth embodiment of a three dimensional ornamental figure of the first embodiment of the stool with the prior art seat in accordance with implementations of this disclosure;

FIG. 125 is a left side elevation view of the sixth embodiment of a three dimensional ornamental figure of the first embodiment of the stool with the prior art seat in accordance with implementations of this disclosure;

FIG. 126 is a front perspective view of the sixth embodiment of a three dimensional ornamental figure of the first embodiment of the stool with the prior art seat in accordance with implementations of this disclosure;

FIG. 127 is a right side elevation view of the sixth embodiment of a three dimensional ornamental figure of the first embodiment of the stool with the prior art seat in accordance with implementations of this disclosure;

FIG. 128 is a rear elevation view in an inverted position of the sixth embodiment of a three dimensional ornamental figure of the first embodiment of the stool with the prior art seat in accordance with implementations of this disclosure;

FIG. 129 is an exploded perspective view of the sixth embodiment of a three dimensional ornamental figure of the first embodiment of the stool with the prior art seat in accordance with implementations of this disclosure;

FIG. 130 is a rear perspective view of the first embodiment of the stool, showing the first embodiment of the seat and a silhouette of a themed figure, in accordance with implementations of this disclosure;

Figure 131:
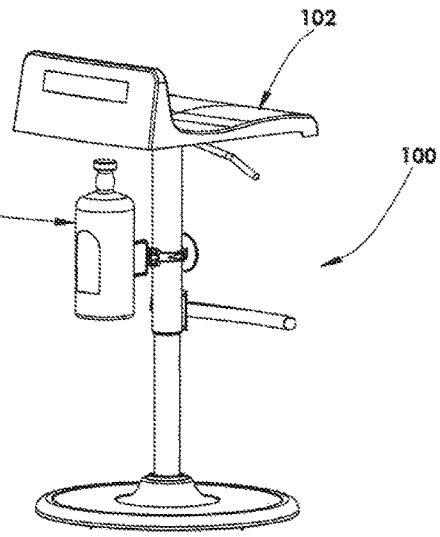
Figure 132:
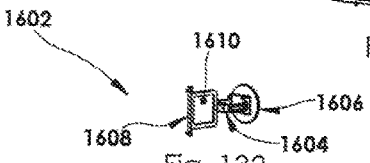
Figure 133:
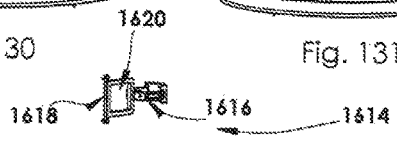
Figure 134:
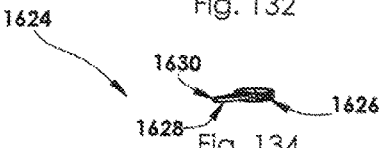
Figure 135:
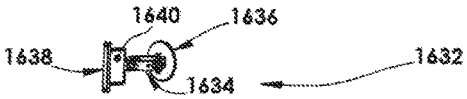
Figure 136:
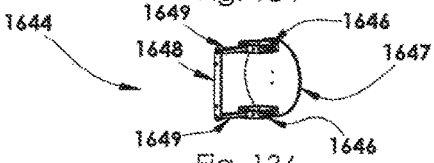
Figure 137:
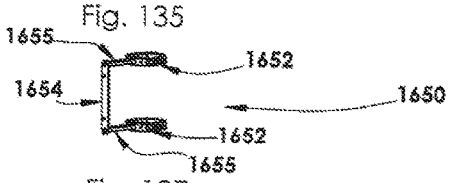
Figure 138:
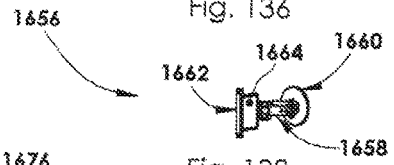
Figure 139:
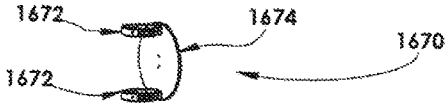
Figure 140:
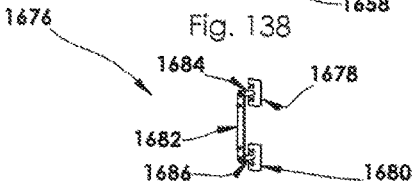
Figure 141:
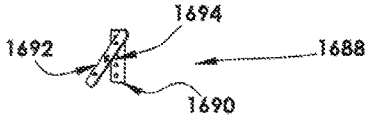
Figure 142:
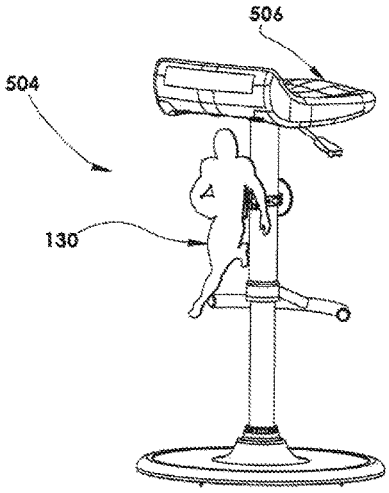
Figure 143:
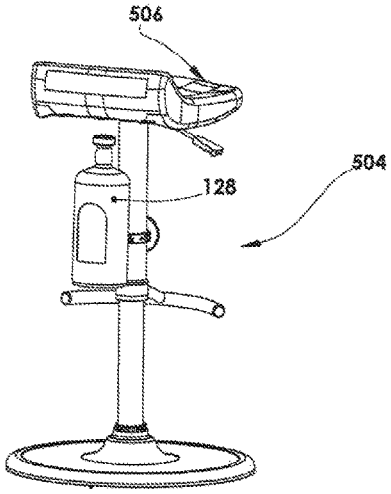
Figure 144:
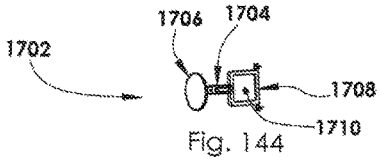
Figure 145:
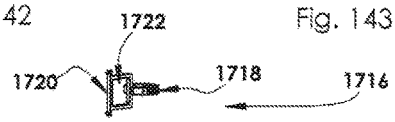
Figure 146:
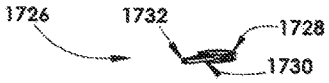
Figure 147:
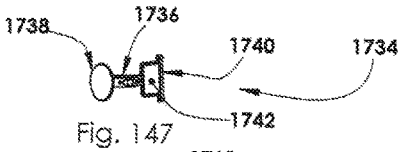
Figure 148:
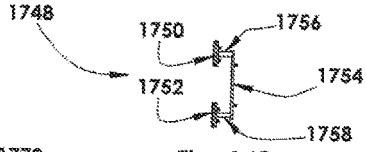
Figure 149:
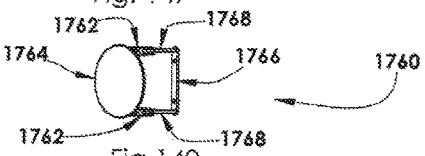
Figure 150:
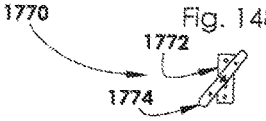
Figure 151:
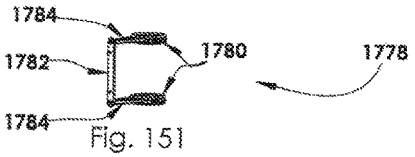
Figure 152:
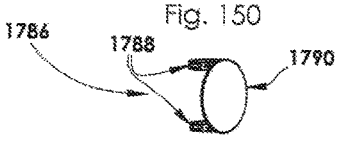
Figure 153:
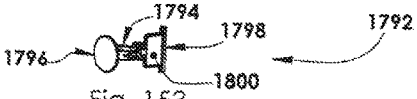
Figure 154:
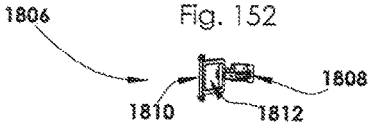
Figure 155:
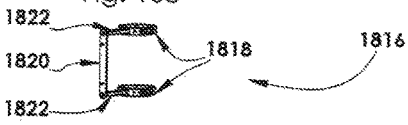
Figure 156:
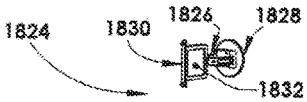
Figure 157:
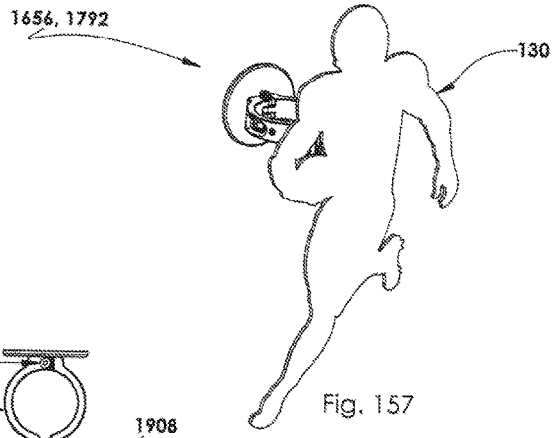
Figure 158:
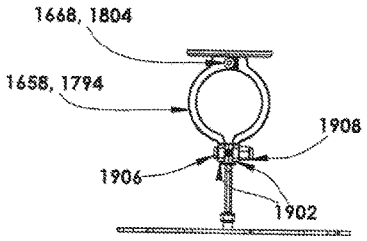
Figure 159:
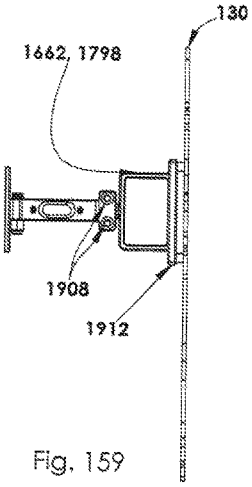
Figure 160:
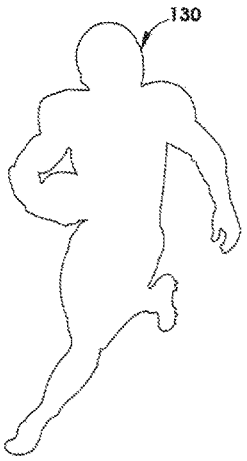
Figure 161:
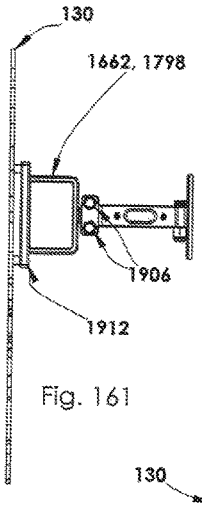
Figure 162:
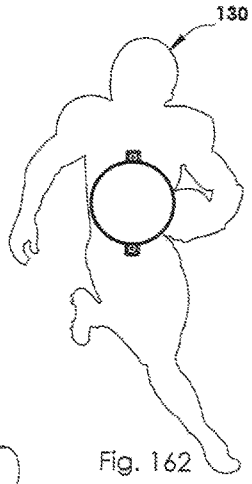
Figure 163:
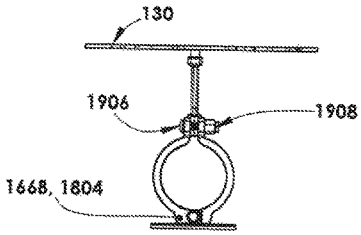
Figure 164:
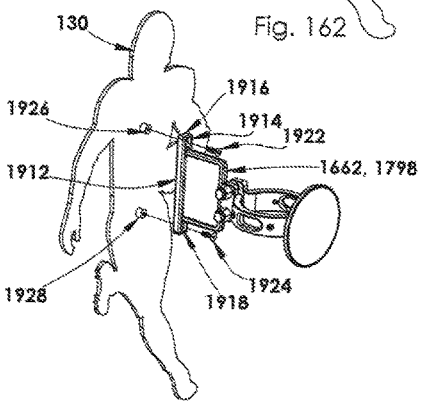
Figure 165:
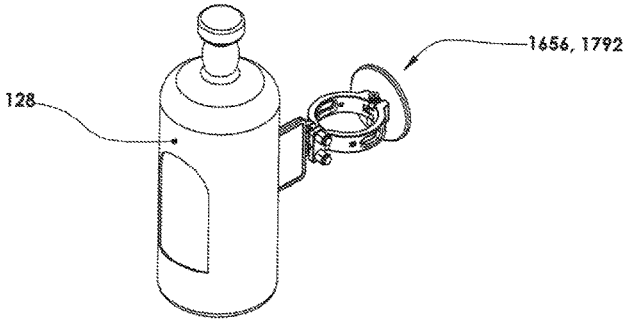
Figure 166:
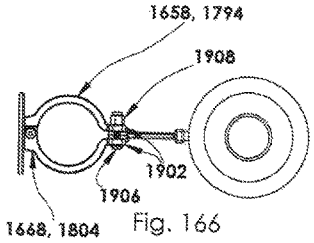
Figure 167:
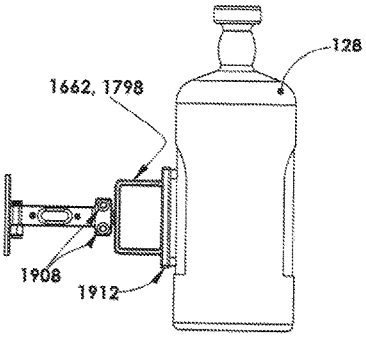
Figure 168:
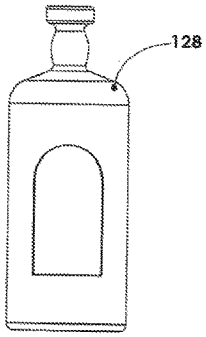
Figure 169:
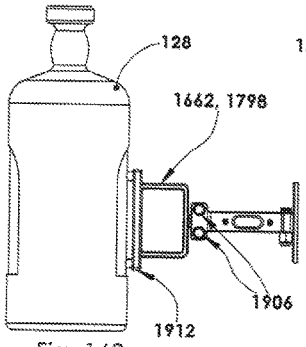
Figure 170:
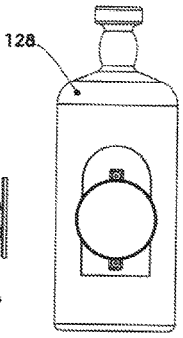
Figure 171:
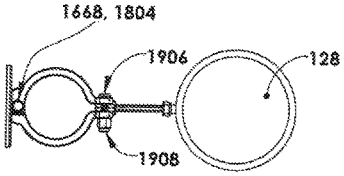
Figure 172:
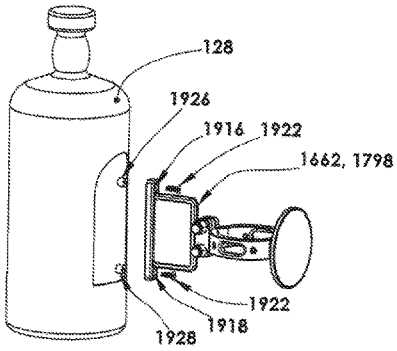
Figure 173:
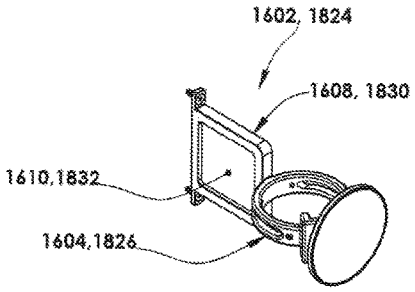
Figure 174:
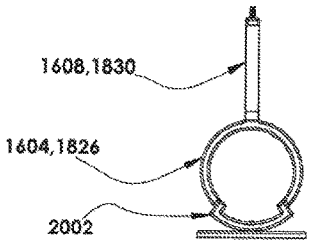
Figure 175:
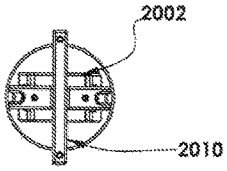
Figure 176:
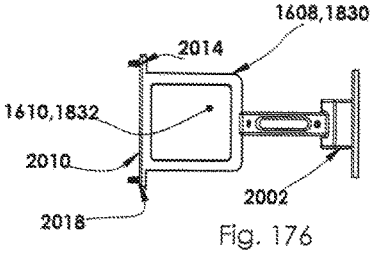
Figure 177:
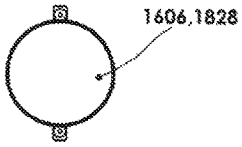
Figure 178:
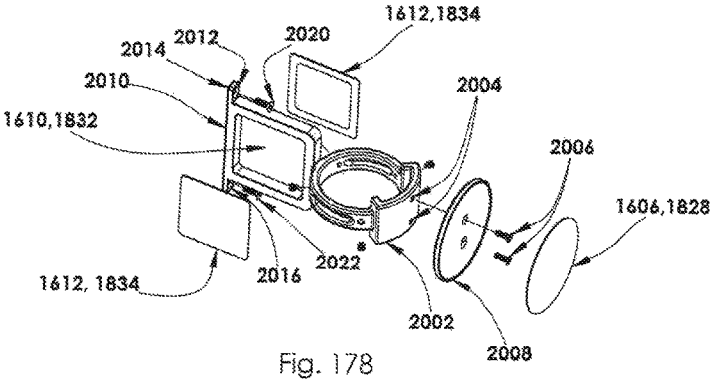
Figure 179:
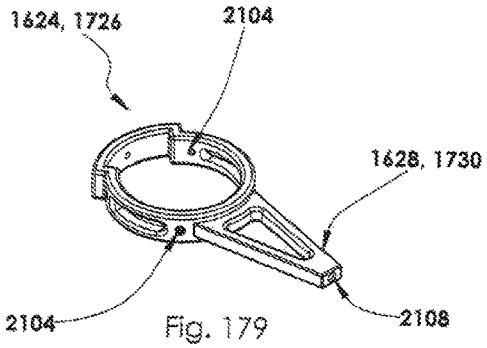
Figure 180:
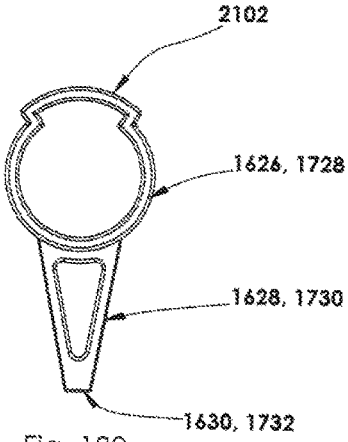
Figure 181:
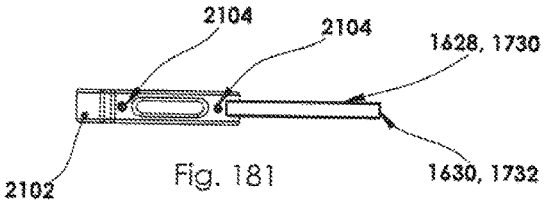
Figure 182:
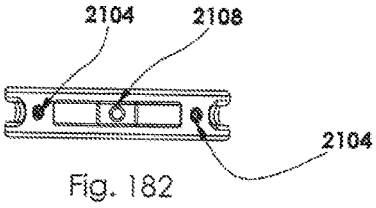
Figure 183:
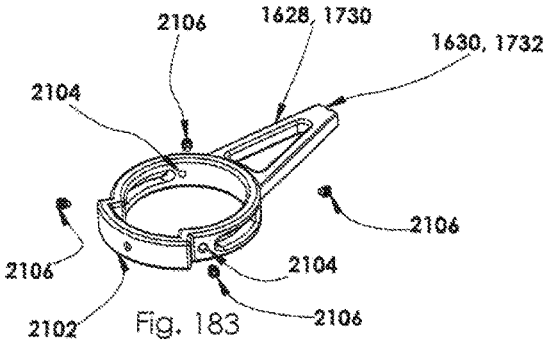
Figure 184:
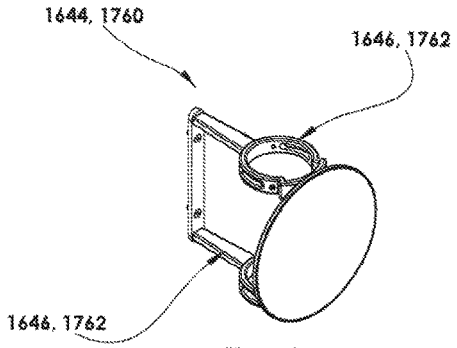
Figure 185:
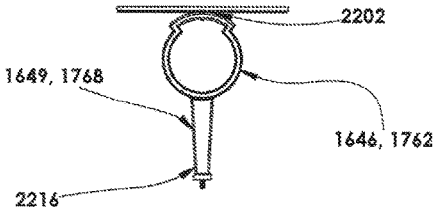
Figure 186:
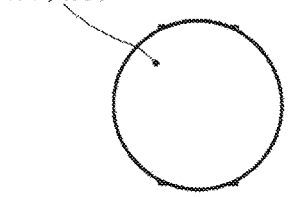
Figure 187:
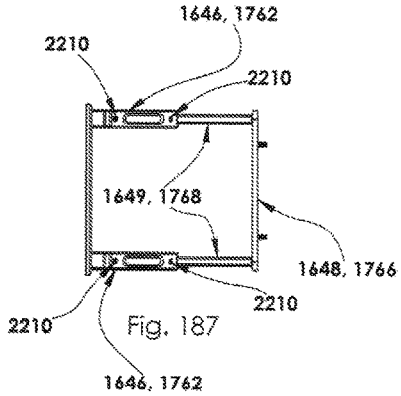
Figure 188:
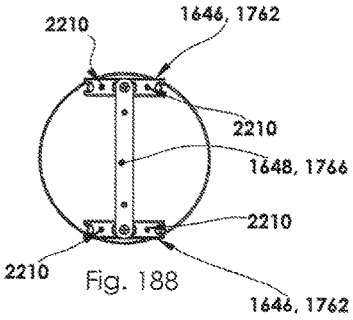
Figure 189:
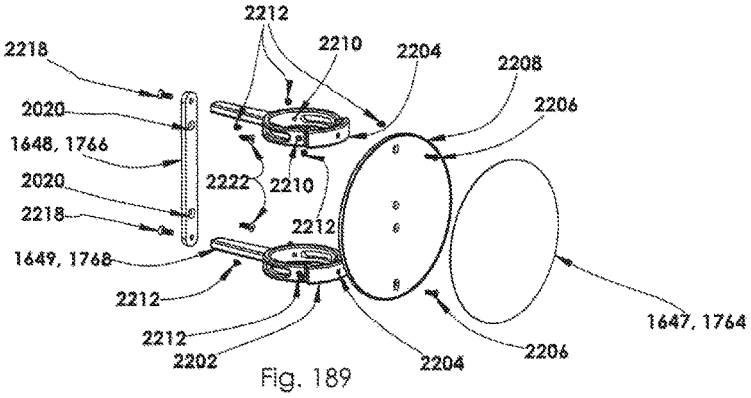
Figure 190:
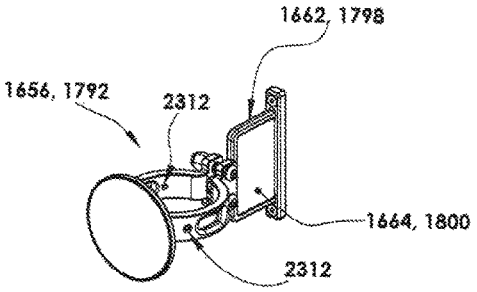
Figure 191:
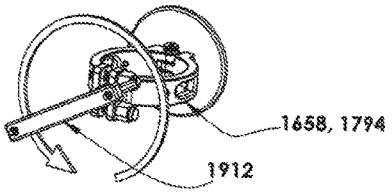
Figure 192:
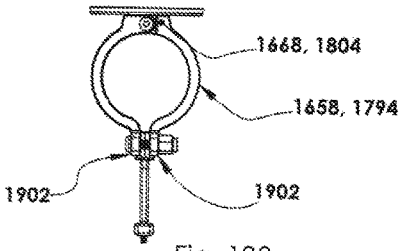
Figure 193:
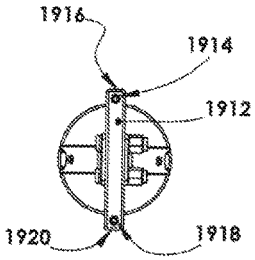
Figure 194:
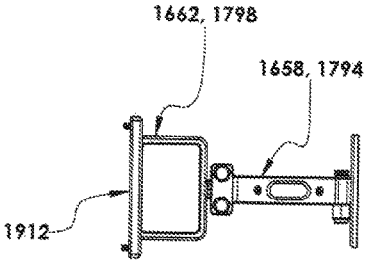
Figure 195:
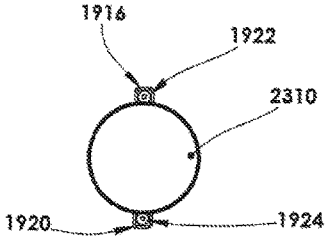
Figure 196:
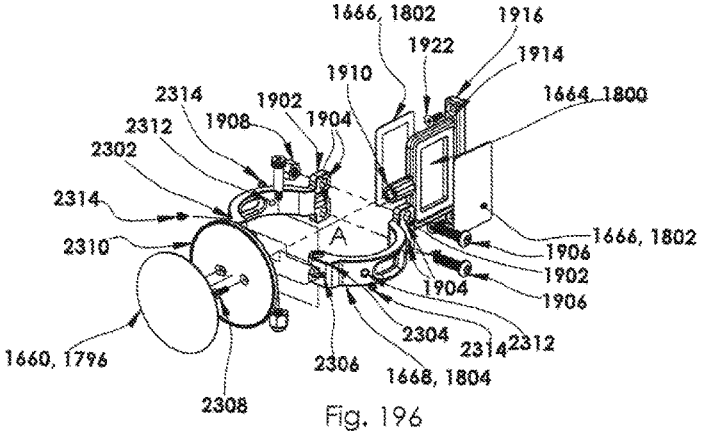
Figure 197:
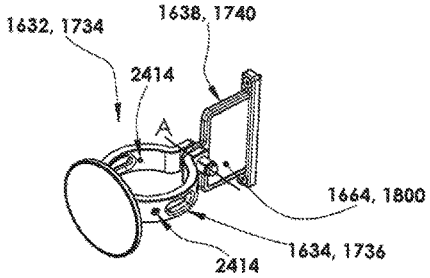
Figure 198:
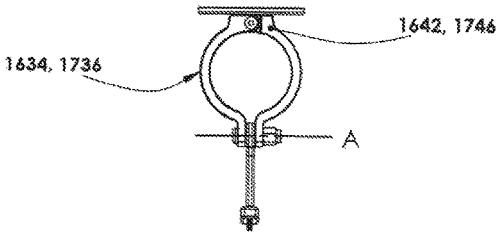
Figure 199:
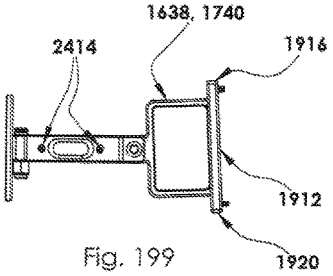
Figure 200:
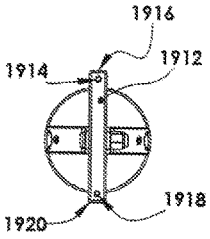
Figure 201:
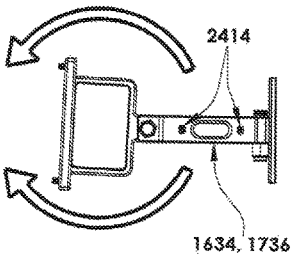
Figure 202:
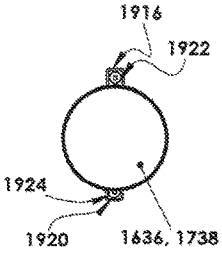
Figure 203:
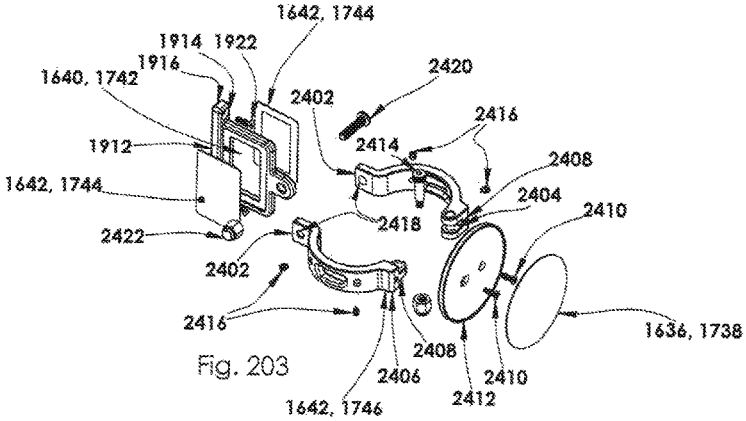
Figure 204:
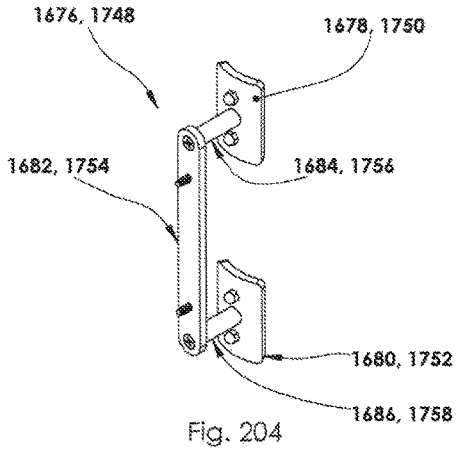
Figure 205:
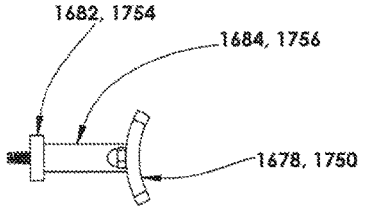
Figure 206:
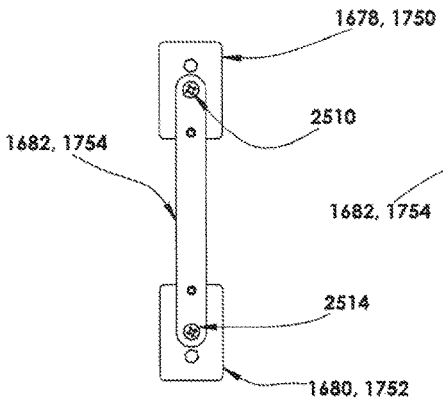
Figure 207:
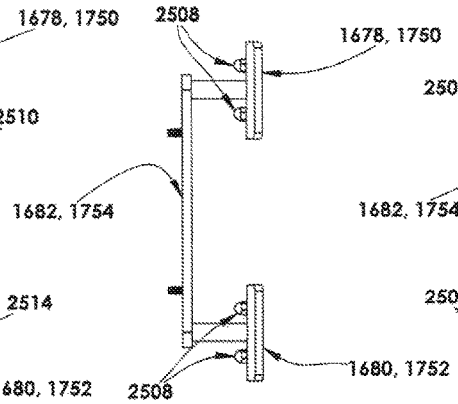
Figure 208:
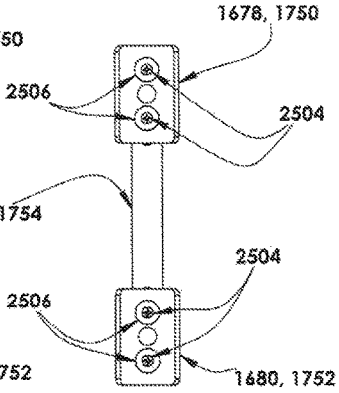
Figure 209:
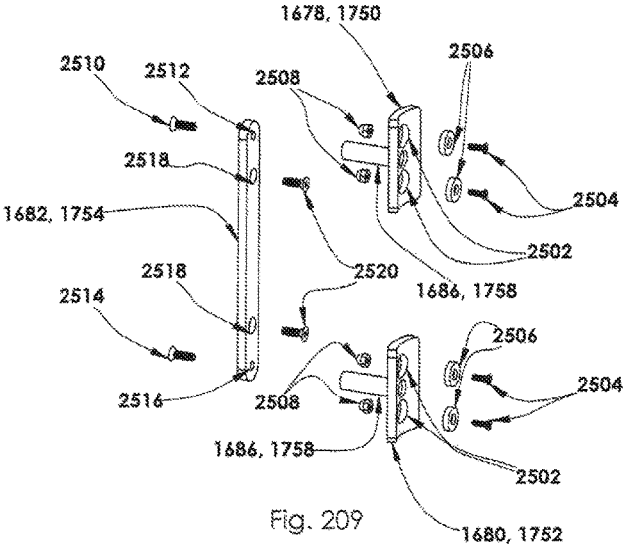
Figure 210:
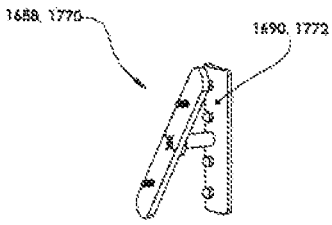
Figure 211:
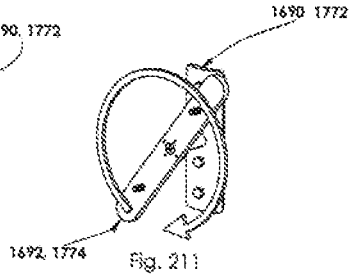
Figure 212:
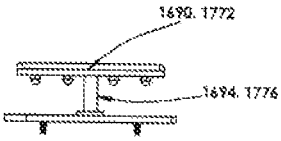
Figure 213:
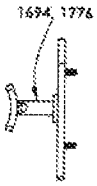
Figure 214:
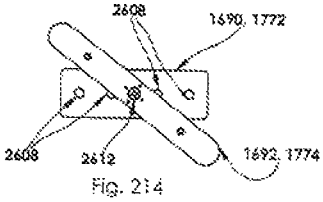
Figure 215:
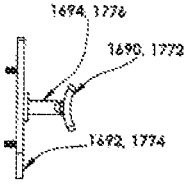
Figure 216:
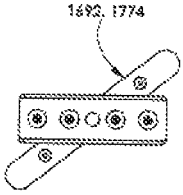
Figure 217:
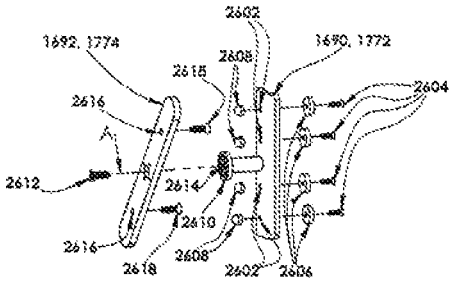
Figure 218:
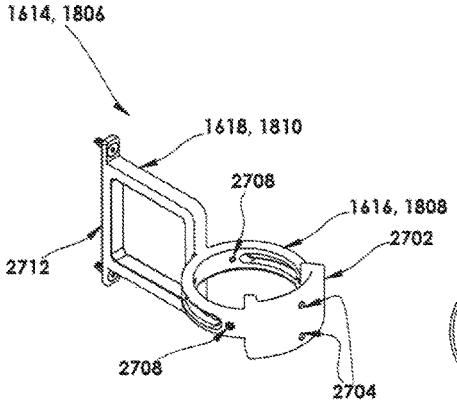
Figure 219:
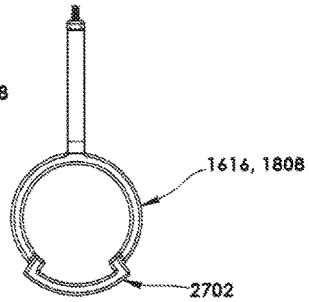
Figure 220:
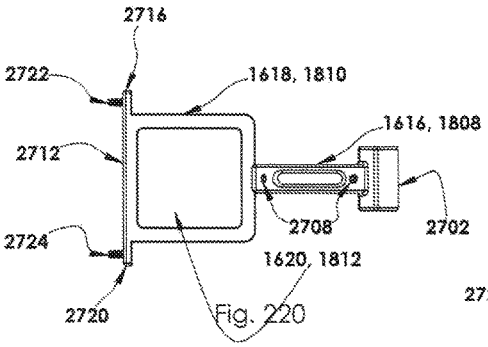
Figure 221:
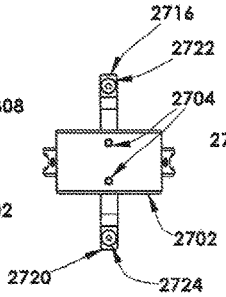
Figure 222:
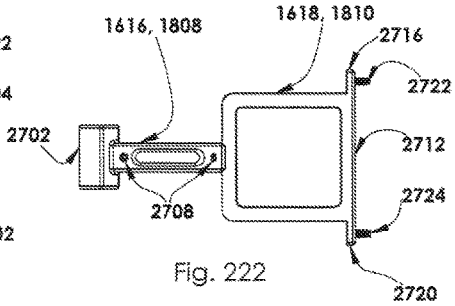
Figure 223:
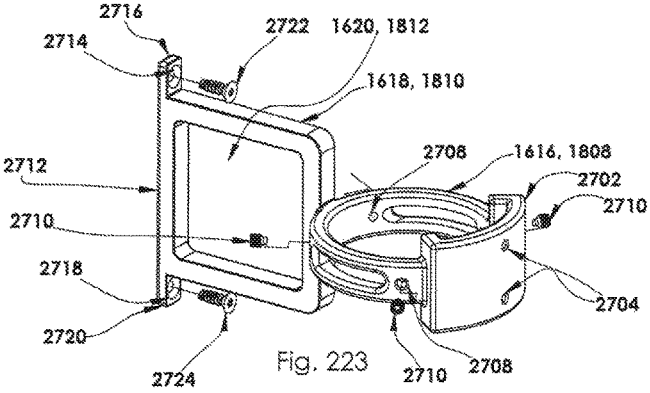
Figure 224:
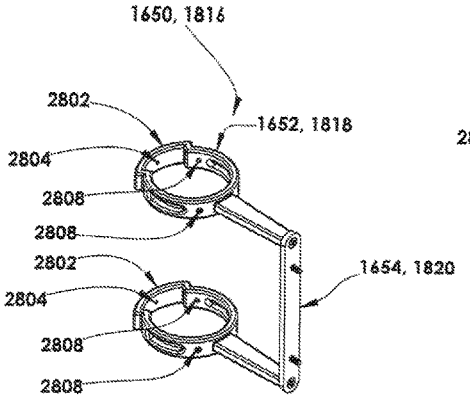
Figure 225:
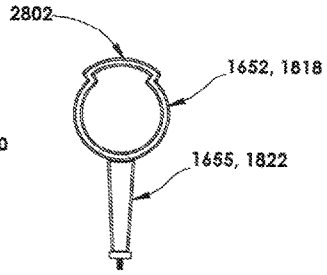
Figure 226:
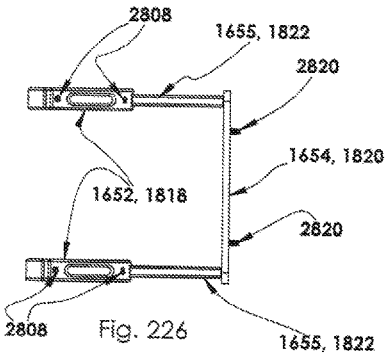
Figure 227:
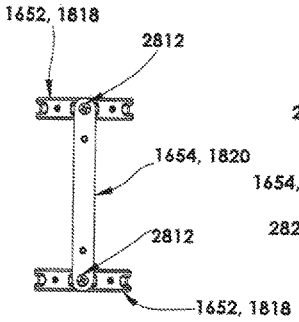
Figure 228:
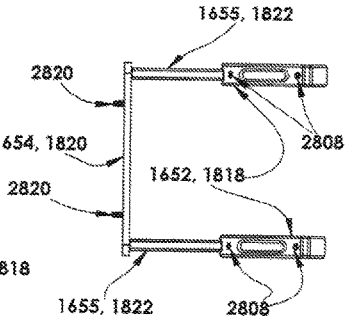
Figure 229:
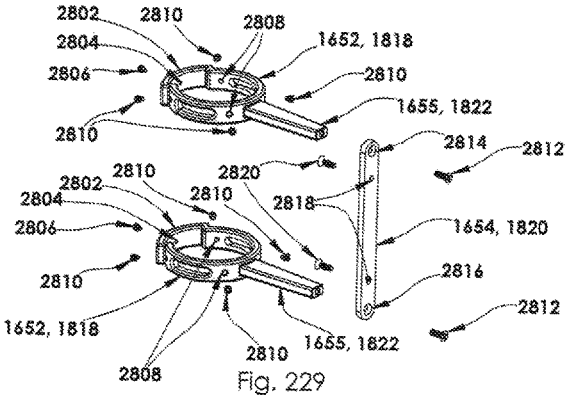
Figure 230:
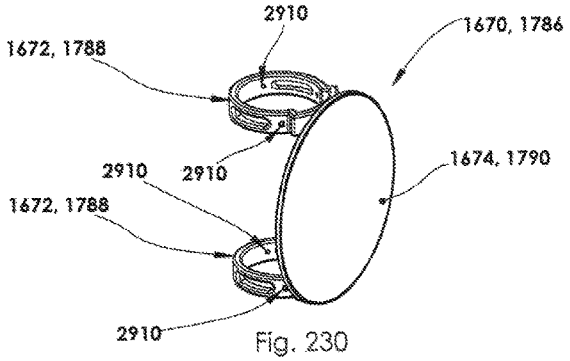
Figure 231:
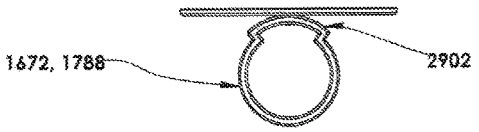
Figure 232:
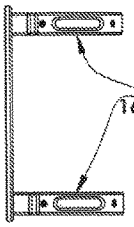
Figure 233:
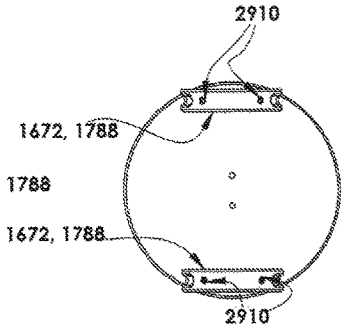
Figure 234:
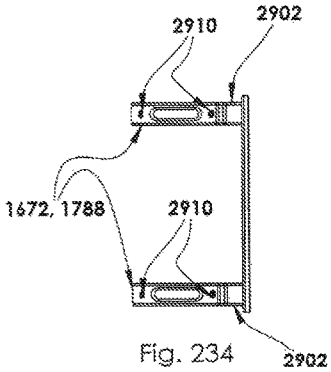
Figure 235:
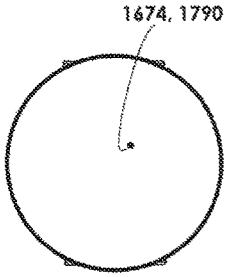
Figure 236:
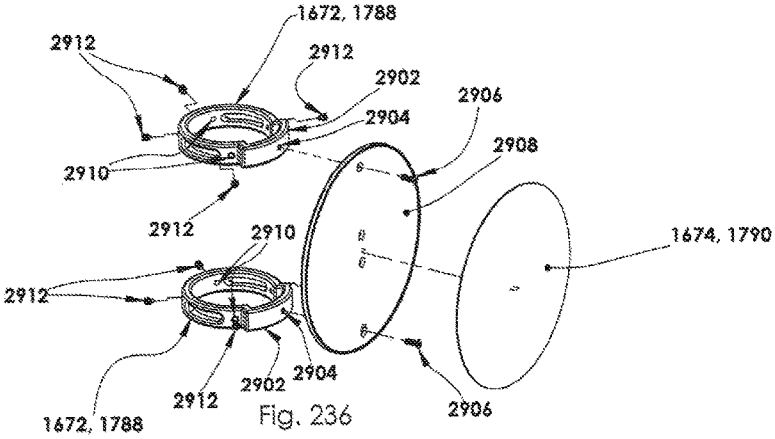
Figure 237:
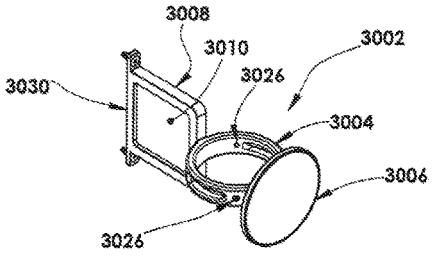
Figure 238:
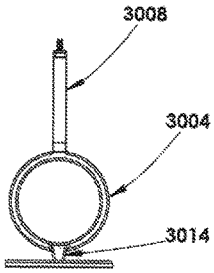
Figure 239:
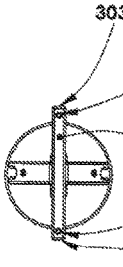
Figure 240:
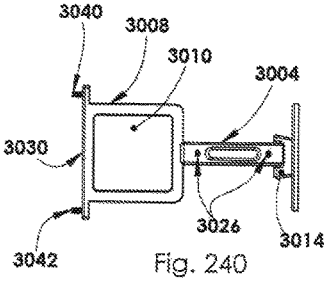
Figure 241:
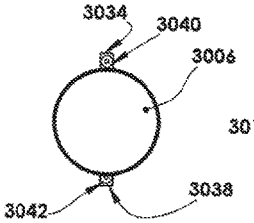
Figure 242:
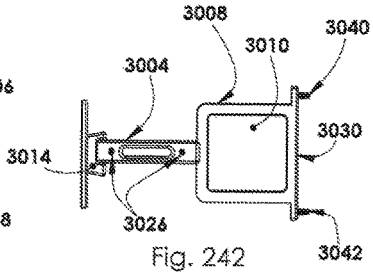
Figure 243:
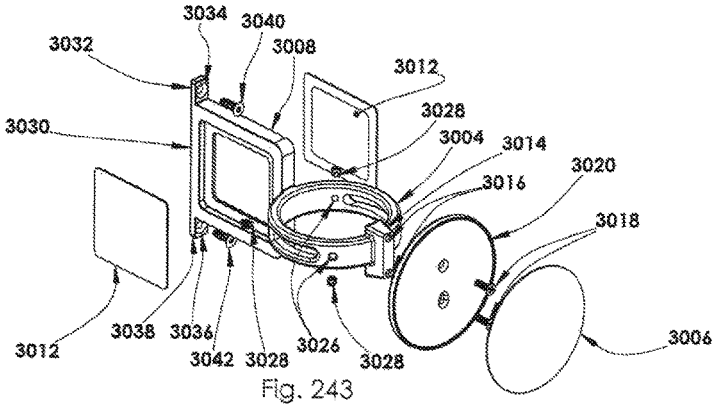
Figure 244:
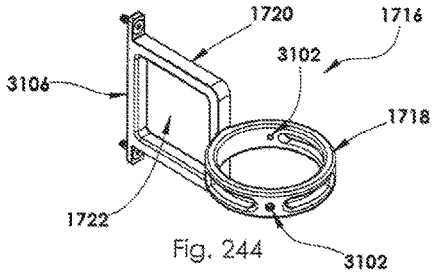
Figure 245:
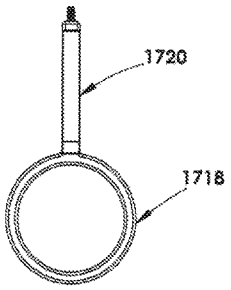
Figure 246:
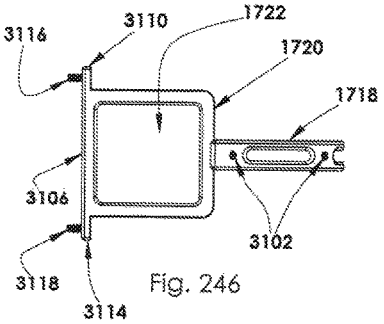
Figure 247:
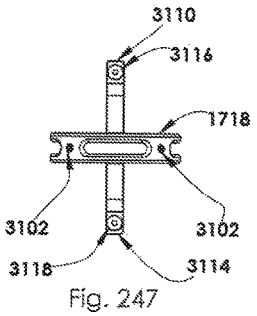
Figure 248:
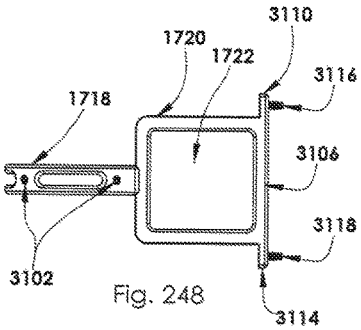
Figure 249:
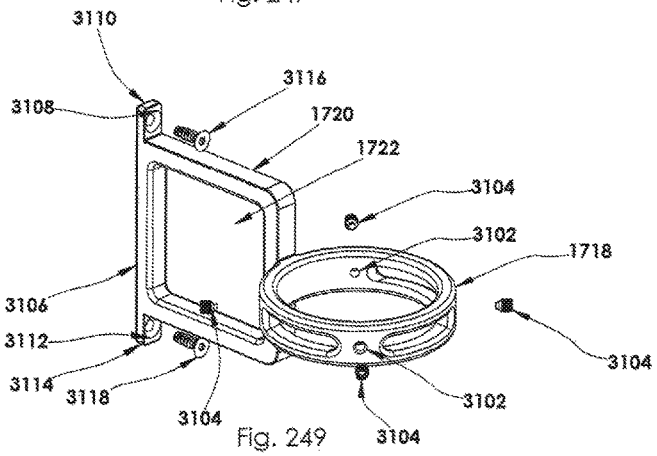
Figure 250:
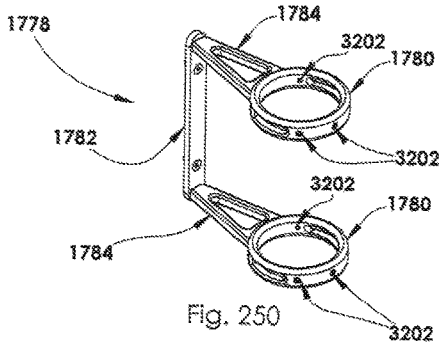
Figure 251:
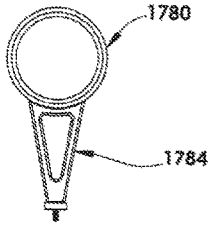
Figure 252:
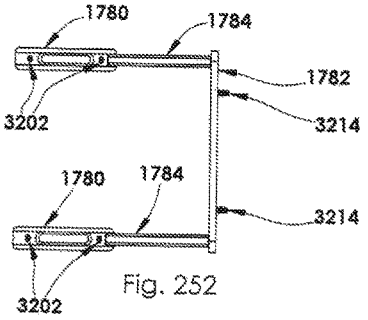
Figure 253:
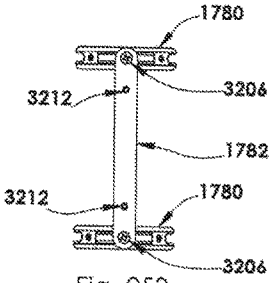
Figure 254:
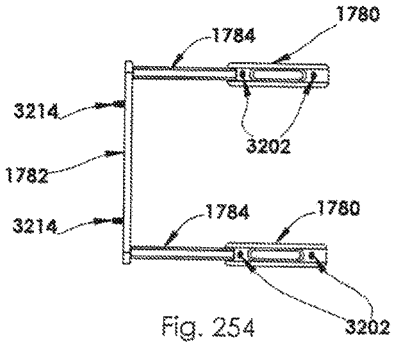
Figure 255:
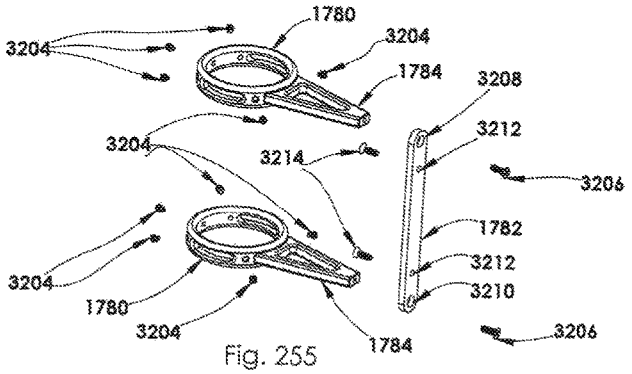

FIG. 131 is a rear perspective view of the first embodiment of the stool, showing the first embodiment of the seat and a three dimensional ornamental figure, such as a beverage bottle figure, in accordance with implementations of this disclosure;

FIG. 132 is a perspective view of a first embodiment of a bracket assembly of the first embodiment of the stool, used with the first embodiment of the seat, in accordance with implementations of this disclosure;

FIG. 133 is a perspective view of a second embodiment of a bracket assembly of the first embodiment of the stool, used with the first embodiment of the seat, in accordance with implementations of this disclosure;

FIG. 134 is a perspective view of a third embodiment of a bracket assembly of the first embodiment of the stool, used with the first embodiment of the seat, in accordance with implementations of this disclosure;

FIG. 135 is a perspective view of a fourth embodiment of a bracket assembly of the first embodiment of the stool, used with the first embodiment of the seat, in accordance with implementations of this disclosure;

FIG. 136 is a perspective view of a fifth embodiment of a bracket assembly of the first embodiment of the stool, used with the first embodiment of the seat, in accordance with implementations of this disclosure;

FIG. 137 is a perspective view of a sixth embodiment of a bracket assembly of the first embodiment of the stool, used with the first embodiment of the seat, in accordance with implementations of this disclosure;

FIG. 138 is a perspective view of a seventh embodiment of a bracket assembly of the first embodiment of the stool, used with the first embodiment of the seat, in accordance with implementations of this disclosure;

FIG. 139 is a perspective view of a eighth embodiment of a bracket assembly of the first embodiment of the stool, used with the first embodiment of the seat, in accordance with implementations of this disclosure;

FIG. 140 is a perspective view of a ninth embodiment of a bracket assembly of the first embodiment of the stool, used with the first embodiment of the seat, in accordance with implementations of this disclosure;

FIG. 141 is a perspective view of a tenth embodiment of a bracket assembly of the first embodiment of the stool, used with the first embodiment of the seat, in accordance with implementations of this disclosure;

FIG. 142 is a rear perspective view of the first embodiment of the stool, showing the prior art seat and a silhouette of a themed figure, in accordance with implementations of this disclosure;

FIG. 143 is a rear perspective view of the first embodiment of the stool, showing the prior art seat and a three dimensional ornamental figure, such as a beverage bottle figure, in accordance with implementations of this disclosure;

FIG. 144 is a perspective view of a first embodiment of a bracket assembly of the first embodiment of the stool, used with the prior art seat, in accordance with implementations of this disclosure;

FIG. 145 is a perspective view of a second embodiment of a bracket assembly of the first embodiment of the stool, used with the prior art seat, in accordance with implementations of this disclosure;

FIG. 146 is a perspective view of a third embodiment of a bracket assembly of the first embodiment of the stool, used with the prior art seat, in accordance with implementations of this disclosure;

FIG. 147 is a perspective view of a fourth embodiment of a bracket assembly of the first embodiment of the stool, used with the prior art seat, in accordance with implementations of this disclosure;

FIG. 148 is a perspective view of a fifth embodiment of a bracket assembly of the first embodiment of the stool, used with the prior art seat, in accordance with implementations of this disclosure;

FIG. 149 is a perspective view of a sixth embodiment of a bracket assembly of the first embodiment of the stool, used with the prior art seat, in accordance with implementations of this disclosure;

FIG. 150 is a perspective view of a seventh embodiment of a bracket assembly of the first embodiment of the stool, used with the prior art seat, in accordance with implementations of this disclosure;

FIG. 151 is a perspective view of a eighth embodiment of a bracket assembly of the first embodiment of the stool, used with the prior art seat, in accordance with implementations of this disclosure;

FIG. 152 is a perspective view of a ninth embodiment of a bracket assembly of the first embodiment of the stool, used with the prior art seat, in accordance with implementations of this disclosure;

FIG. 153 is a perspective view of a tenth embodiment of a bracket assembly of the first embodiment of the stool, used with the prior art seat, in accordance with implementations of this disclosure;

FIG. 154 is a perspective view of a eleventh embodiment of a bracket assembly of the first embodiment of the stool, used with the prior art seat, in accordance with implementations of this disclosure;

FIG. 155 is a perspective view of a twelfth embodiment of a bracket assembly of the first embodiment of the stool, used with the prior art seat, in accordance with implementations of this disclosure;

FIG. 156 is a perspective view of a thirteenth embodiment of a bracket assembly of the first embodiment of the stool, used with the prior art seat, in accordance with implementations of this disclosure;

FIG. 157 is a perspective view of the silhouette of a themed figure, shown with the seventh embodiment of the bracket assembly of the first embodiment of the stool, used with the first embodiment of the seat, in accordance with implementations of this disclosure;

FIG. 158 is a top elevation view of the silhouette of a themed figure, shown with the seventh embodiment of the bracket assembly of the first embodiment of the stool, used with the first embodiment of the seat, in accordance with implementations of this disclosure;

FIG. 159 is a left side elevation view of the silhouette of a themed figure, shown with the seventh embodiment of the bracket assembly of the first embodiment of the stool, used with the first embodiment of the seat, in accordance with implementations of this disclosure;

FIG. 160 is a front elevation view of the silhouette of a themed figure, shown with the seventh embodiment of the bracket assembly of the first embodiment of the stool, used with the first embodiment of the seat, in accordance with implementations of this disclosure;

FIG. 161 is a right side elevation view of the silhouette of a themed figure, shown with the seventh embodiment of the bracket assembly of the first embodiment of the stool, used with the first embodiment of the seat, in accordance with implementations of this disclosure;

FIG. 162 is a rear elevation view of the silhouette of a themed figure, shown with the seventh embodiment of the bracket assembly of the first embodiment of the stool, used with the first embodiment of the seat, in accordance with implementations of this disclosure;

FIG. 163 is a bottom elevation view of the silhouette of a themed figure, shown with the seventh embodiment of the bracket assembly of the first embodiment of the stool, used with the first embodiment of the seat, in accordance with implementations of this disclosure;

FIG. 164 is an exploded rear perspective view of the silhouette of a themed figure, shown with the seventh embodiment of the bracket assembly of the first embodiment of the stool, used with the first embodiment of the seat, in accordance with implementations of this disclosure;

FIG. 165 is a perspective view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 166 is a top elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 167 is a left side elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 168 is a front elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 169 is a right side elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 170 is a rear elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 171 is a bottom elevation view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 172 is an exploded rear perspective view of the three dimensional ornamental figure, such as the beverage bottle, shown with the seventh embodiment of the bracket assembly of the first embodiment of the stool, used with the first embodiment of the seat, in accordance with implementations of this disclosure;

FIG. 173 is a perspective view of the first embodiment of the bracket assembly of the first embodiment of the stool, used with the first embodiment of the seat, or the thirteenth embodiment of the bracket assembly of the second embodiment of the stool, used with the prior art seat, in accordance with implementations of this disclosure;

FIG. 174 is a top elevation view of the first embodiment of the bracket assembly of the first embodiment of the stool, used with the first embodiment of the seat, or the thirteenth embodiment of the bracket assembly of the second embodiment of the stool, used with the prior art seat, in accordance with implementations of this disclosure;

FIG. 175 is a rear elevation view of the first embodiment of the bracket assembly of the first embodiment of the stool, used with the first embodiment of the seat, or the thirteenth embodiment of the bracket assembly of the second embodiment of the stool, used with the prior art seat, in accordance with implementations of this disclosure;

FIG. 176 is a side elevation view of the first embodiment of the bracket assembly of the first embodiment of the stool, used with the first embodiment of the seat, or the thirteenth embodiment of the bracket assembly of the second embodiment of the stool, used with the prior art seat, in accordance with implementations of this disclosure;

FIG. 177 is a front elevation view of the first embodiment of the bracket assembly of the first embodiment of the stool, used with the first embodiment of the seat, or the thirteenth embodiment of the bracket assembly of the second embodiment of the stool, used with the prior art seat, in accordance with the implementations of this disclosure;

FIG. 178 is an exploded perspective view of the first embodiment of the bracket assembly of the first embodiment of the stool, used with the first embodiment of the seat, or the thirteenth embodiment of the bracket assembly of the second embodiment of the stool, used with the prior art seat, in accordance with implementations of this disclosure;

FIG. 179 is a perspective view of the third embodiment of the bracket assembly of the first embodiment of the stool, used with the first embodiment of the seat, or the third embodiment of the bracket assembly of the second embodiment of the stool, in accordance with implementations of this disclosure;

FIG. 180 is a top elevation view of the third embodiment of the bracket assembly of the first embodiment of the stool, used with the first embodiment of the seat, or the third embodiment of the bracket assembly of the second embodiment of the stool, in accordance with implementations of this disclosure;

FIG. 181 is a side elevation view of the third embodiment of the bracket assembly of the first embodiment of the stool, used with the first embodiment of the seat, or the third embodiment of the bracket assembly of the second embodiment of the stool, in accordance with implementations of this disclosure;

FIG. 182 is front elevation view of the third embodiment of the bracket assembly of the first embodiment of the stool, used with the first embodiment of the seat, or the third embodiment of the bracket assembly of the second embodiment of the stool, in accordance with implementations of this disclosure;

FIG. 183 is an exploded perspective view of the third embodiment of the bracket assembly of the first embodiment of the stool, used with the first embodiment of the seat, or the third embodiment of the bracket assembly of the second embodiment of the stool, in accordance with implementations of this disclosure;

FIG. 184 is a perspective view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 185 is a top elevation view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 186 is a front elevation view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 187 is a side elevation view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 188 is a rear elevation view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 189 is an exploded perspective view of the fifth embodiment of the bracket assembly of the first embodiment of the stool, used with the first embodiment of the seat, or the sixth embodiment of the bracket assembly of the second embodiment of the stool, in accordance with implementations of this disclosure;

FIG. 190 is a perspective view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 191 is a perspective view of the seventh embodiment of the bracket assembly of the first embodiment of the stool, used with the first embodiment of the seat, or the tenth embodiment of the bracket assembly of the second embodiment of the stool, showing an attachment bracket and plate rotatable about Axis A of FIG. 196, in accordance with implementations of this disclosure;

FIG. 192 is a top elevation view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 193 is a rear elevation view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 194 is a side elevation view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 195 is a front elevation view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 196 is an exploded perspective view of the seventh embodiment of the bracket assembly of the first embodiment of the stool, used with the first embodiment of the seat, or the tenth embodiment of the bracket assembly of the second embodiment of the stool, in accordance with implementations of this disclosure;

FIG. 197 is a perspective view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 198 is a top elevation view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 199 is a side elevation view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 200 is a rear elevation view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 201 is a top elevation view of the fourth embodiment of the bracket assembly of the first embodiment of the stool, used with the first embodiment of the seat, or the fourth embodiment of the bracket assembly of the second embodiment of the stool, showing an attachment bracket and plate rotatable about Axis A of FIG. 197, in accordance with implementations of this disclosure;

FIG. 202 is a front elevation view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 203 is an exploded perspective view of the fourth embodiment of the bracket assembly of the first embodiment of the stool, used with the first embodiment of the seat, or the fourth embodiment of the bracket assembly of the second embodiment of the stool, in accordance with implementations of this disclosure;

FIG. 204 is a perspective view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 205 is a top elevation view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 206 is a front elevation view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 207 is a side elevation view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 208 is a rear elevation view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 209 is an exploded perspective view of the ninth embodiment of the bracket assembly of the first embodiment of the stool, used with the first embodiment of the seat, or the fifth embodiment of the bracket assembly of the second embodiment of the stool, in accordance with implementations of this disclosure;

FIG. 210 is a perspective view of the tenth embodiment of the bracket assembly of the first embodiment of the stool, used with the first embodiment of the seat, or the seventh embodiment of the bracket assembly of the second embodiment of the stool, in accordance with implementations of this disclosure;

FIG. 211 is a perspective view of the tenth embodiment of the bracket assembly of the first embodiment of the stool, used with the first embodiment of the seat, or the seventh embodiment of the bracket assembly of the second embodiment of the stool, showing an attachment bracket rotatable about Axis A of FIG. 217, in accordance with implementations of this disclosure;

FIG. 212 is a side elevation view in a 180 degree position of the tenth embodiment of the bracket assembly of the first embodiment of the stool, used with the first embodiment of the seat, or the seventh embodiment of the bracket assembly of the second embodiment of the stool, in accordance with implementations of this disclosure;

FIG. 213 is a top elevation view of the tenth embodiment of the bracket assembly of the first embodiment of the stool, used with the first embodiment of the seat, or the seventh embodiment of the bracket assembly of the second embodiment of the stool, in accordance with implementations of this disclosure;

FIG. 214 is a front elevation view in a 180 degree position of the tenth embodiment of the bracket assembly of the first embodiment of the stool, used in the first embodiment of the seat, or the seventh embodiment of the bracket assembly of the second embodiment of the stool, in accordance with implementations of this disclosure;

FIG. 215 is a bottom elevation view of the tenth embodiment of the bracket assembly of the first embodiment of the stool, used with the first embodiment of the seat, or the seventh embodiment of the bracket assembly of the second embodiment of the stool, in accordance with implementations of this disclosure;

FIG. 216 is a rear elevation view in a 180 degree position of the tenth embodiment of the bracket assembly of the first embodiment of the stool, used in the first embodiment of the seat, or the seventh embodiment of the bracket assembly of the second embodiment of the stool, in accordance with implementations of this disclosure;

FIG. 217 is an exploded perspective view of the tenth embodiment of the bracket assembly of the first embodiment of the stool, used in the first embodiment of the seat, or the seventh embodiment of the bracket assembly of the second embodiment of the stool, in accordance with implementations of this disclosure;

FIG. 218 is a perspective view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 219 is a top elevation view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 220 is a right side elevation view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 221 is a front elevation view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 222 is a left side elevation view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 223 is an exploded perspective view of the second embodiment of the bracket assembly of the first embodiment of the stool, using the first embodiment of the seat, or the eleventh embodiment of the bracket assembly of the second embodiment of the stool, in accordance with implementations of this disclosure;

FIG. 224 is a perspective view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 225 is a top elevation view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 226 is a left side elevation view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 227 is a front elevation view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 228 is a right side elevation view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 229 is an exploded perspective view of the sixth embodiment of the bracket assembly of the first embodiment of the stool, using the first embodiment of the seat, or the twelfth embodiment of the bracket assembly of the second embodiment of the stool, in accordance with implementations of this disclosure;

FIG. 230 is a perspective view of the eighth embodiment of the bracket assembly of the first embodiment of the stool, using the first embodiment of the seat, or the ninth embodiment of the bracket assembly of the second embodiment of the stool, in accordance with implementations of this disclosure;

FIG. 231 is a top elevation view of the eighth embodiment of the bracket assembly of the first embodiment of the stool, using the first embodiment of the seat, or the ninth embodiment of the bracket assembly of the second embodiment of the stool, in accordance with implementations of this disclosure;

FIG. 232 is a right side elevation view of the eighth embodiment of the bracket assembly of the first embodiment of the stool, using the first embodiment of the seat, or the ninth embodiment of the bracket assembly of the second embodiment of the stool, in accordance with implementations of this disclosure;

FIG. 233 is a rear elevation view of the eighth embodiment of the bracket assembly of the first embodiment of the stool, using the first embodiment of the seat, or the ninth embodiment of the bracket assembly of the second embodiment of the stool, in accordance with implementations of this disclosure;

FIG. 234 is a left side elevation view of the eighth embodiment of the bracket assembly of the first embodiment of the stool, using the first embodiment of the seat, or the ninth embodiment of the bracket assembly of the second embodiment of the stool, in accordance with implementations of this disclosure;

FIG. 235 is a front elevation view of the eighth embodiment of the bracket assembly of the first embodiment of the stool, using the first embodiment of the seat, or the ninth embodiment of the bracket assembly of the second embodiment of the stool, in accordance with the implementations of this disclosure;

FIG. 236 is an exploded perspective view of the eighth embodiment of the bracket assembly of the first embodiment of the stool, using the first embodiment of the seat, or the ninth embodiment of the bracket assembly of the second embodiment of the stool, in accordance with the implementations of this disclosure;

FIG. 237 is a perspective view of a fourteenth embodiment of the bracket assembly of the first embodiment of the stool in accordance with implementations of this disclosure;

FIG. 238 is a top elevation view of the fourteenth embodiment of the bracket assembly of the first embodiment of the stool in accordance with implementations of this disclosure;

FIG. 239 is a rear elevation view of the fourteenth embodiment of the bracket assembly of the first embodiment of the stool in accordance with implementations of this disclosure;

FIG. 240 is a right side elevation view of the fourteenth embodiment of the bracket assembly of the first embodiment of the stool in accordance with implementations of this disclosure;

FIG. 241 is a front elevation view of the fourteenth embodiment of the bracket assembly of the first embodiment of the stool in accordance with implementations of this disclosure;

FIG. 242 is a left side elevation view of the fourteenth embodiment of the bracket assembly of the first embodiment of the stool in accordance with implementations of this disclosure;

FIG. 243 is an exploded perspective view of the fourteenth embodiment of the bracket assembly of the first embodiment of the stool in accordance with implementations of this disclosure;

FIG. 244 is a perspective view of the second embodiment of the bracket assembly of the first embodiment of the stool, using the prior art seat, in accordance with implementations of this disclosure;

FIG. 245 is a top elevation view of the second embodiment of the bracket assembly of the first embodiment of the stool, using the prior art seat, in accordance with implementations of this disclosure;

FIG. 246 is a right side elevation view of the second embodiment of the bracket assembly of the first embodiment of the stool, using the prior art seat, in accordance with implementations of this disclosure;

FIG. 247 is a front elevation view of the second embodiment of the bracket assembly of the first embodiment of the stool, using the prior art seat, in accordance with implementations of this disclosure;

FIG. 248 is a left side elevation view of the second embodiment of the bracket assembly of the first embodiment of the stool, using the prior art seat, in accordance with implementations of this disclosure;

FIG. 249 is an exploded perspective view of the second embodiment of the bracket assembly of the first embodiment of the stool, using the prior art seat, in accordance with implementations of this disclosure;

FIG. 250 is a perspective view of the eighth embodiment of the bracket assembly of the first embodiment of the stool, using the prior art seat, in accordance with implementations of this disclosure;

FIG. 251 is a top elevation view of the eighth embodiment of the bracket assembly of the first embodiment of the stool, using the prior art seat, in accordance with implementations of this disclosure;

FIG. 252 is a left side elevation view of the eighth embodiment of the bracket assembly of the first embodiment of the stool, using the prior art seat, in accordance with implementations of this disclosure;

FIG. 253 is a front elevation view of the eighth embodiment of the bracket assembly of the first embodiment of the stool, using the prior art seat, in accordance with implementations of this disclosure;

FIG. 254 is a right side elevation view of the eighth embodiment of the bracket assembly of the first embodiment of the stool, using the prior art seat, in accordance with implementations of this disclosure; and FIG. 255 is an exploded perspective view of the eighth embodiment of the bracket assembly of the first embodiment of the stool, using the prior art seat, in accordance with implementations of this disclosure.

DETAILED DESCRIPTION

Residential homes may have a kitchen and/or bar area that includes stools. Commercial establishments may include a bar and/or high-top tables that include stools. Commercial establishments may want to promote a sport, a particular team, and/or a particular brand on their walls as well as on their bar stools. Homeowners that are particularly interested in a sport, particular team, or brand may also want to have a bar stool that includes figures and/or graphics of the theme they are interested in. Themed bar stools can include a silhouette of a themed figure and/or three dimensional ornamental figures. Additionally, the themed bar stool can include graphics on the base of the stool, on the attachment mechanism for the silhouette or three dimensional figure, and on the seat of the stool. The bar stool can also include lights, such as light emitting diode (LED) lights to highlight the figure, the graphics, or simply illuminate the bar stool itself and the area around where the bar stool is situated.

Referring to FIGS. 1-11, a first embodiment of a stool 100 is shown comprising a first embodiment of a seat 102, a mainframe component 104, an inner shaft 106, a lower shaft 108, and a removable base 110. The stool 100 can include a three dimensional ornamental figure 128 (FIG. 144) and/or a silhouette of a themed FIG. 130 (FIG. 143). The mainframe component 104 comprises a planar mounting surface 112, a mainframe shaft 114, and a foot support component 116 laterally extending from a distal end 117 of the mainframe shaft 114. The seat 102 is fastened on the planar mounting surface 112 of the mainframe component 104, shown in FIG. 8, using screws, nuts and bolts, glue, welding, or any other fastening means as is known in the art. The foot support component 116 is also fastened to the distal end 117 of mainframe shaft 114 using screws, nuts and bolts, glue, welding, or any other fastening means as is known in the art. A lever mechanism 118 laterally extends from an upper end of the mainframe shaft 114 subjacent to the planar mounting surface 112. Lever mechanism 118 is manually vertically adjustable to raise or lower seat 102 by applying or releasing pressure to a cylindrical plunger 120 at the top end of the inner shaft 106, causing the inner shaft 106 to descend, shown in FIG. 11, or ascend, shown in FIG. 10, respectively, within the lower shaft 108. The removable base 110 can include interchangeable decorative graphics 122 that can be changed by removing the base 110 from the lower shaft 108. The interchangeable decorative graphics 122 can be fastened to the removable base 110 and the removable base 110 can be fastened to the lower shaft 108 using screws, nuts and bolts, glue, welding, or any other fastening means as is known in the art. A bottom 124 of the removable base 110 can include at least one pad 126, shown in FIG. 8, to prevent sliding of the stool 100, such as rubber pads, felt pads, or other slide-preventing padding as is known in the art.

The first embodiment of seat 102 is shown in FIGS. 12-19. Seat 102 comprises a seat support 202 and a vertically extending back support 204 that includes a panel 206. The panel 206 can include a decorative graphic 208 secured to the back support 204 by a translucent or transparent window and/or lens 210. A bottom 212 of the seat 102 can include a light emitting diode (LED) printed circuit board (PCB) 214, shown in FIG. 13, to illuminate the stool 100 and/or any of the graphics and a battery 216, fastened to the bottom 212 of the seat 102 by a cover 218. The cover 218, shown in FIGS. 13 and 18, includes a panel 220 and a plurality of LED lights 222 that can be operated by a switch and/or remotely controlled.

The removable base 110 is shown in FIGS. 20-28. The removable base 110 comprises an aperture 302 that receives the lower shaft 108 of the stool 100. The interchangeable decorative graphic 122, shown in FIG. 28, can be secured to the base 110 using, in this illustrated embodiment, a plurality of screws 304 that engage a plurality of threaded apertures 306 in the base 110, shown in detail in FIG. 27. The removable base 110 can include a plurality of pads 126 that engage, in this illustrated embodiment, a plurality of apertures 308 on the bottom 124 of the removable base 110, shown in detail in FIG. 26. The plurality of screws 304 and the plurality of pads 126, in this illustrated embodiment, can be used simultaneously as long as they use their respective apertures.

The mainframe component 104 is shown in FIGS. 29-38. The lever mechanism 118 extends from the upper end of the mainframe shaft 114 and is connected to a lever mechanism housing 402, shown in FIGS. 30-37, subjacent to the planar mounting surface 112, with a pin 404, shown in FIGS. 37 and 38. The foot support component 116 comprises an attachment bracket 406 that fastens the foot support component 116 to the mainframe shaft 114 using screws, nuts and bolts, glue, welding, or any other fastening means as is known in the art. An arcuate foot support arm 408 is connected to a cantilever arm 410 that laterally extends from the attachment bracket 406. Each end 412, 414 of the foot support arm 408 can include a plug 416, 418. The distal end 117 of the mainframe shaft 114 includes a plastic bushing 420.

Referring to FIGS. 39-42, the stool 100 with seat 102 is shown with a first embodiment of a three dimensional ornamental figure 502, such as a football helmet figure in this exemplary embodiment, attached to the mainframe shaft 114 of the mainframe component 104. A second embodiment of the stool 504 comprising a seat 506 as is known in the art is shown in FIGS. 43-46 with the first embodiment of the three dimension figure 502 attached to the mainframe shaft 114 of the mainframe component 104.

Referring to FIGS. 47-50, the stool 100 with seat 102 is shown with a second embodiment of a three dimensional ornamental figure 602, such as a baseball catcher helmet figure in this exemplary embodiment, attached to the mainframe shaft 114 of the mainframe component 104. The second embodiment of the stool 504 comprising the seat 506 as is known in the art is shown in FIGS. 51-54 with the second embodiment of the three dimension figure 602 attached to the mainframe shaft 114 of the mainframe component 104.

Referring to FIGS. 55-58, the stool 100 with seat 102 is shown with a third embodiment of a three dimensional ornamental figure 702, such as a racing and/or motorcycle helmet figure in this exemplary embodiment, attached to the mainframe shaft 114 of the mainframe component 104. The second embodiment of the stool 504 comprising the seat 506 as is known in the art is shown in FIGS. 59-62 with the third embodiment of the three dimensional figure 702 attached to the mainframe shaft 114 of the mainframe component 104.

Referring to FIGS. 63-66, the stool 100 with seat 102 is shown with a fourth embodiment of a three dimensional ornamental figure 802, such as a hockey goalie mask helmet figure in this exemplary embodiment, attached to the mainframe shaft 114 of the mainframe component 104. The second embodiment of the stool 504 comprising the seat 506 as is known in the art is shown in FIGS. 67-70 with the fourth embodiment of the three dimension figure 802 attached to the mainframe shaft 114 of the mainframe component 104.

A three dimensional ornamental figure mounting bracket 902 is shown in detail in FIGS. 71-76. The support bracket 902 comprises a cylindrical or annular sleeve 904 that has an upper end 906 and a lower end 908. Disposed approximately half-way between the upper end 906 and the lower end 908 is a laterally extending flange 910. The lower end 908 includes a plurality of apertures 912 configured to fasten the mounting bracket 902 to the mainframe shaft 114 using, in this illustrated embodiment, a plurality of nuts and bolts 914. Other fastening means, such as welding or braising, as is known in the art can also be used to fasten the support bracket 902 to the mainframe shaft 114. The flange 910 includes a plurality of apertures 916 configured to fasten the three dimensional ornamental figure 130 to the mounting bracket 902 using, in this illustrated embodiment, a plurality of bushings 918 and a plurality of nuts 920 that engage a plurality of bolts 922 extending from each of the plurality of apertures 916. Other fastening means, such as welding or braising, as is known in the art can also be used to fasten the three dimensional ornamental figure 130 to the mounting bracket 902.

Referring to FIGS. 77-80, the stool 100 with seat 102 is shown with a fifth embodiment of a three dimensional ornamental figure 1002, such as a basketball and hoop figure in this exemplary embodiment, attached to the mainframe shaft 114 of the mainframe component 104. The second embodiment of the stool 504 comprising the seat 506 as is known in the art is shown in FIGS. 81-84 with the fifth embodiment of the three dimension figure 1002 attached to the mainframe shaft 114 of the mainframe component 104.

The fifth embodiment of the three dimensional ornamental figure 1002 is shown in detail in FIGS. 85-91. The three dimensional ornamental figure 1002 in this exemplary embodiment comprises a basketball figure 1102 and a net figure 1104 that includes a rim 1106. The basketball figure 1102 includes a first half 1108 and a second half 1110, shown in FIG. 91. The first half 1102 includes an upper cutout 1112 and a lower cutout 1114 and the second half 1104 includes an upper cutout 1116 and a lower cutout 1118 that are configured to receive the mainframe shaft 114 when the first half 1102 and the second half 1104 are fastened together. The first half 1102 and the second half 1104 also include a front cutout 1120, 1122, respectively, that is configured to retain an illuminated or non-illuminated decorative graphic 1130 when the first half 1102 and the second half 1104 are fastened together. The cut-outs are semi-circular in this illustrated embodiment but in other embodiments the cut-outs can be of various shapes. The net figure 1104 includes a cylindrical or annular sleeve mounting bracket 1124, shown in FIG. 91, attached to the net figure 1104 adjacent the rim 1106 that fastens the three dimensional ornamental figure 1002 to the mainframe shaft 114 of the mainframe component 104. The net figure 1104 can also include a battery 1126 and an LED PCB 1128, shown in FIG. 91, that can be switch or remote control activated to illuminate the decorative graphic 1130 disposed in the basketball figure 1102.

A three dimensional ornamental figure rear support adjustable bracket 1202 is shown in detail in FIGS. 92-98. The adjustable bracket 1202 comprises an upper bracket 1204 that includes an elongated slot 1206 and a flange 1208 extending upwardly from a distal end 1210, the flange 1208 including a plurality of apertures 1212. The adjustable bracket 1202 also comprises a lower bracket 1214 that includes an aperture 1216 and a flange 1218 extending downwardly from a distal end 1220 of the lower bracket 1214, the flange 1218 including at least one aperture 1222. The upper bracket 1204 and the lower bracket 1214 are laterally adjustable, adjusting the distance between flange 1208 and flange 1218 to fit the size of the three dimensional ornamental figure 130. The adjustable bracket 1202 can be secured at the desired length by using, in this illustrated embodiment, a screw 1224 and nut 1226 in the elongated slot 1206. The plurality of apertures 1212 of the flange 1208 and the at least one aperture 1222 of flange 1218 are configured to secure the adjustable bracket 1202 to the three dimensional ornamental figure 130 using, in this illustrated embodiment, screws 1228 and nuts 1230. Other fastening means, such as welding or braising, as is known in the art can also be used to fasten the three dimensional ornamental figure 130 to the adjustable bracket 1202.

Referring to FIGS. 99-106, the stool 100 with seat 102 is shown with a sixth embodiment of a three dimensional ornamental figure 1302, such as a beverage can figure in this exemplary embodiment, attached to the mainframe shaft 114 of the mainframe component 104.

The sixth embodiment of the three dimensional ornamental figure 1302 for stool 100 with seat 102 is shown in detail in FIGS. 107-115. The three dimensional ornamental figure 1302 in this exemplary embodiment comprises a beverage can figure 1402 that includes an upper aperture 1404 and a lower aperture 1406 that are configured to receive the mainframe shaft 114. The beverage can figure 1402 also includes an outwardly extending mounting bracket 1408 that is configured to fasten the beverage can figure 1402 to the mainframe shaft 114 using, in this illustrated embodiment, a plurality of double sided tape 1410. Other fastening means, such as screws, nuts, welding, or braising, as is known in the art can also be used to fasten the mounting bracket 1408 to the mainframe shaft 114.

Referring to FIGS. 115-122, the second embodiment of the stool 504, comprising the seat 506 as is known in the art, is shown with the sixth embodiment of the three dimensional ornamental figure 1302 attached to the mainframe shaft 114 of the mainframe component 104.

The sixth embodiment of the three dimensional ornamental figure 1302 for stool 504 with seat 506 is shown in detail in FIGS. 123-129. The three dimensional ornamental figure 1302 in this exemplary embodiment comprises a beverage can figure 1502 that includes an upper aperture 1504 and a lower aperture 1506 that are configured to receive the mainframe shaft 114. The beverage can figure 1502 also includes an outwardly extending mounting bracket 1508 that is configured to fasten the beverage can figure 1502 to the mainframe shaft 114 using, in this illustrated embodiment, a plurality of double sided tape 1510. Other fastening means, such as screws, nuts, welding, or braising, as is known in the art can also be used to fasten the mounting bracket 1508 to the mainframe shaft 114.

Figure 1:
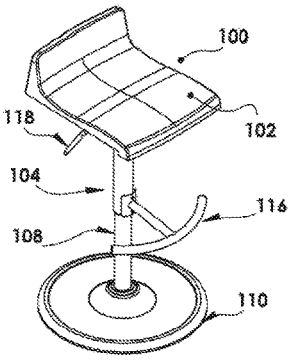
FIG. 1 is a perspective view of a first embodiment of a stool, shown with a first embodiment of a seat, in accordance with implementations of this disclosure.
Figure 2:
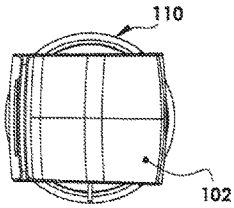
FIG. 2 is a top elevation view of the first embodiment of the stool, shown with the first embodiment of the seat, in accordance with implementations of this disclosure.
Figure 3:
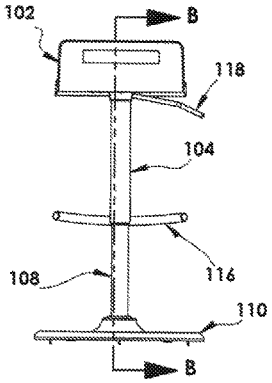
FIG. 3 is a rear elevation view of the first embodiment of the stool, shown with the first embodiment of the seat, in accordance with implementations of this disclosure.
Figure 4:
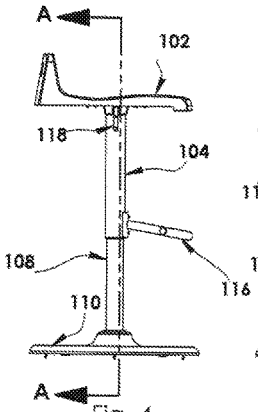
FIG. 4 is a right side elevation view of the first embodiment of the stool, shown with the first embodiment of the seat, in accordance with implementations of this disclosure.
Figure 5:
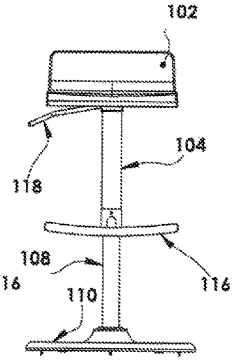
FIG. 5 is a front elevation view of the first embodiment of the stool, shown with the first embodiment of the seat, in accordance with implementations of this disclosure.
Figure 6:
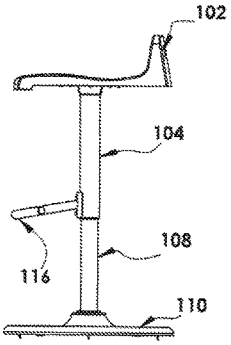
FIG. 6 is a left side elevation view of the first embodiment of the stool, shown with the first embodiment of the seat, in accordance with implementations of this disclosure.
Figure 7:
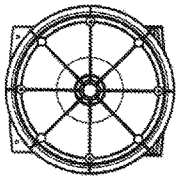
FIG. 7 is a bottom elevation view of the first embodiment of the stool in accordance with implementations of this disclosure.
Figure 8:
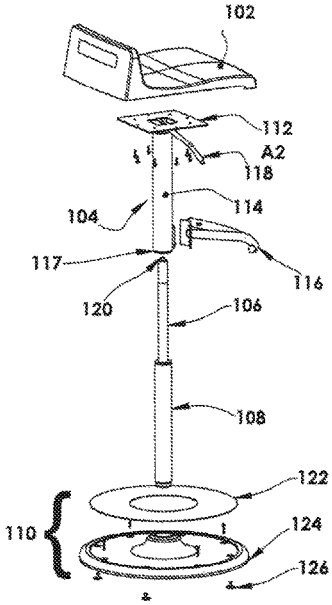
FIG. 8 is an exploded perspective view of the first embodiment of the stool, shown with the first embodiment of the seat, in accordance with implementations of this disclosure.
Figure 9:
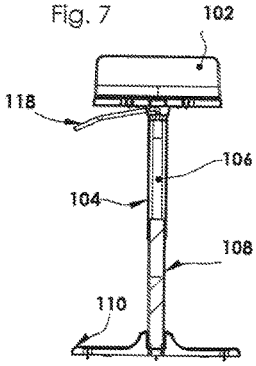
FIG. 9 is a cross-sectional view of the first embodiment of the stool taken along line A-A of FIG. 4, shown with the first embodiment of the seat, in accordance with implementations of this disclosure.
Figure 10:
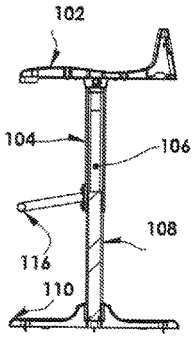
FIG. 10 is a cross-sectional view of the first embodiment of the stool taken along line B-B of FIG. 3, shown with the first embodiment of the seat, in accordance with implementations of this disclosure.
Figure 11:
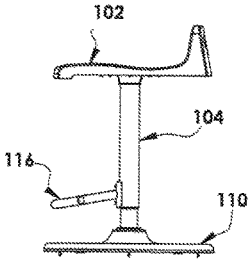
FIG. 11 is a left side elevation view of the first embodiment of the stool, the stool shown in a lowered position and shown with the first embodiment of the seat, in accordance with implementations of this disclosure.
Figure 12:
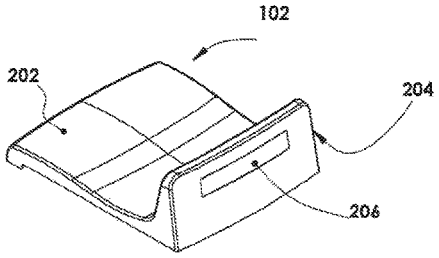
FIG. 12 is a rear perspective view of the first embodiment of the seat in accordance with implementations of this disclosure.
Figure 13:
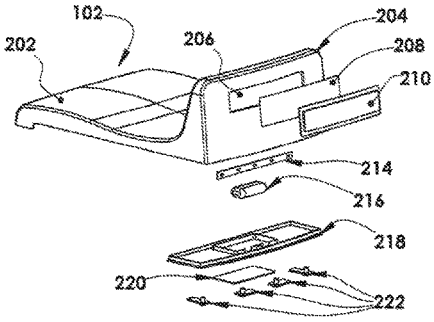
FIG. 13 is an exploded view of a rear of the first embodiment of the seat in accordance with implementations of this disclosure.
Figure 14:
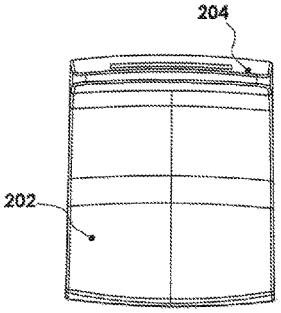
FIG. 14 is a top elevation view of the first embodiment of the seat in accordance with implementations of this disclosure.
Figure 15:
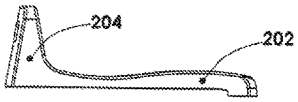
FIG. 15 is a right side elevation view of the first embodiment of the seat in accordance with implementations of this disclosure.
Figure 16:
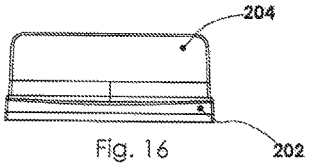
FIG. 16 is a front elevation view of the first embodiment of the seat in accordance with implementations of this disclosure.
Figure 17:
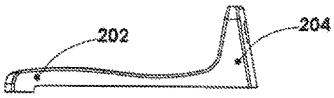
FIG. 17 is a left side elevation view of the first embodiment of the seat in accordance with implementations of this disclosure.
Figure 18:
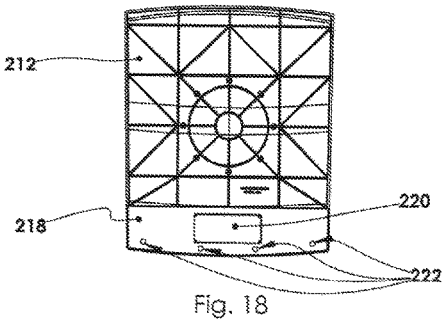
FIG. 18 is a bottom elevation view of the first embodiment of the seat in accordance with implementations of this disclosure.
Figure 19:
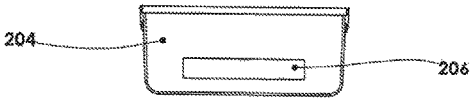
FIG. 19 is a rear elevation view in an inverted position of the first embodiment of the seat in accordance with implementations of this disclosure.
Figure 20:
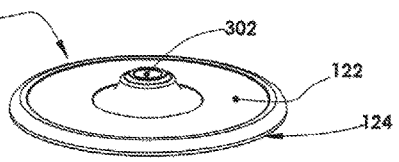
FIG. 20 is a perspective view of a base of the first embodiment of the stool in accordance with implementations of this disclosure.
Figure 21:
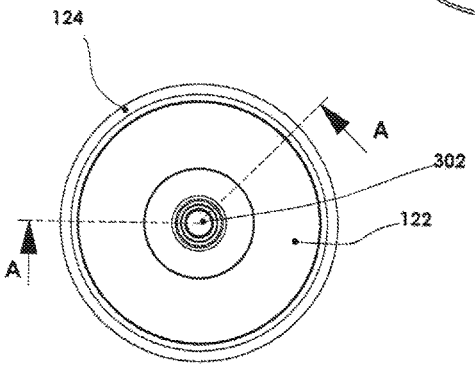
FIG. 21 is a top elevation view of the base of the first embodiment of the stool in accordance with implementations of this disclosure.
Figure 22:
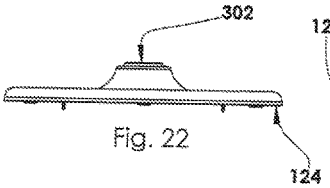
FIG. 22 is a right side elevation view of the base of the first embodiment of the stool in accordance with implementations of this disclosure.
Figure 23:
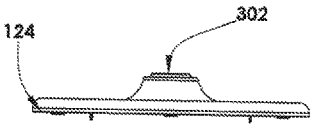
FIG. 23 is a left side elevation view of the base of the first embodiment of the stool in accordance with implementations of this disclosure.
Figure 24:
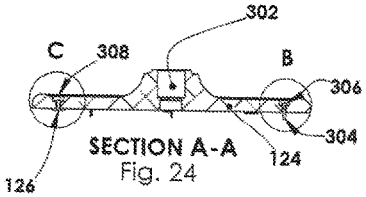
FIG. 24 is a cross-sectional view of the base of the first embodiment of the stool taken along line A-A of FIG. 21 in accordance with implementations of this disclosure.
Figure 25:
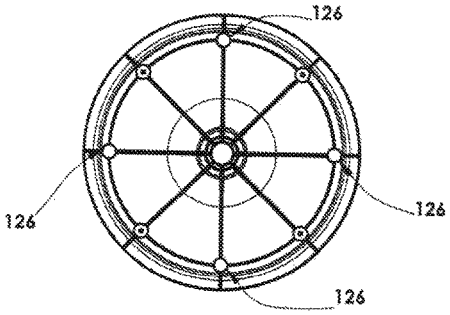
FIG. 25 is a bottom elevation view of the base of the first embodiment of the stool in accordance with implementations of this disclosure.
Figure 26:
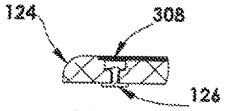
FIG. 26 is a cross-sectional view of the base of the first embodiment of the stool, showing Detail C of FIG. 24, in accordance with implementations of this disclosure.
Figure 27:
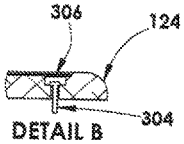
FIG. 27 is a cross-sectional view of the base of the first embodiment of the stool, showing Detail B of FIG. 24, in accordance with implementations of this disclosure.
Figure 28:
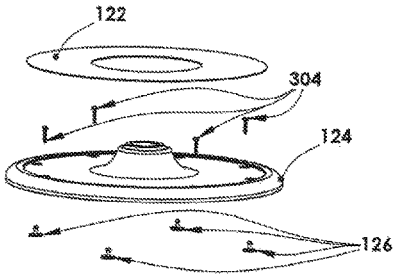
FIG. 28 is an exploded perspective view of the base of the first embodiment of the stool in accordance with implementations of this disclosure.
Figure 29:
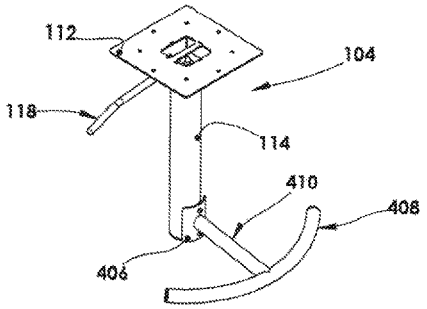
FIG. 29 is a perspective view of a mainframe component of the first embodiment of the stool in accordance with implementations of this disclosure.
Figure 30:
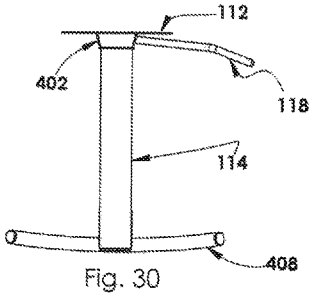
FIG. 30 is a rear elevation view of the mainframe component of the first embodiment of the stool in accordance with implementations of this disclosure.
Figure 31:
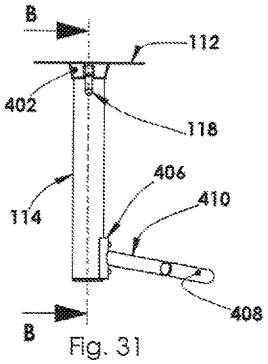
FIG. 31 is a right side elevation view of the mainframe component of the first embodiment of the stool in accordance with implementations of this disclosure.
Figure 32:
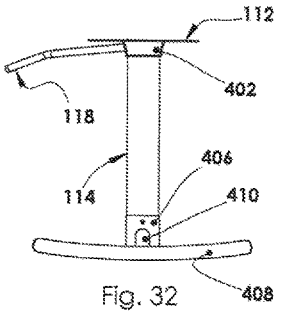
FIG. 32 is a front elevation view of the mainframe component of the first embodiment of the stool in accordance with implementations of this disclosure.
Figure 33:
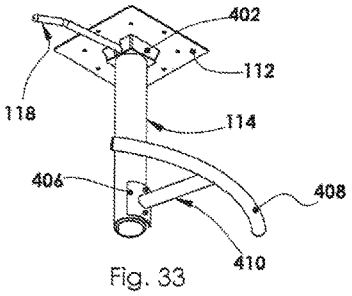
FIG. 33 is a bottom perspective view of the mainframe component of the first embodiment of the stool in accordance with implementations of this disclosure.
Figure 34:
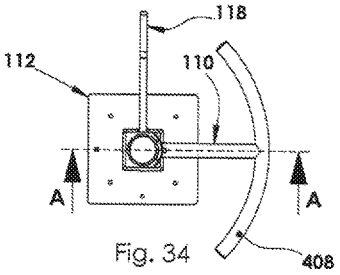
FIG. 34 is a bottom elevation view of the mainframe component of the first embodiment of the stool in accordance with implementations of this disclosure.
Figure 35:
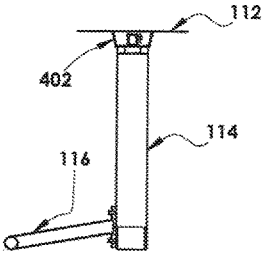
FIG. 35 is a cross-sectional view of the mainframe component of the first embodiment of the stool taken along line A-A of FIG. 34 in accordance with implementations of this disclosure.
Figure 36:
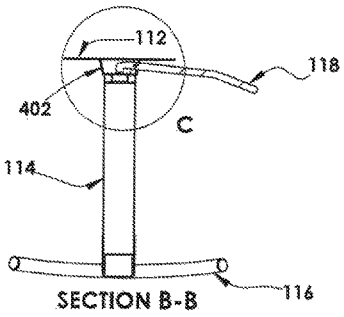
FIG. 36 is a rear elevation view of the mainframe component of the first embodiment of the stool in accordance with implementations of this disclosure.
Figure 37:
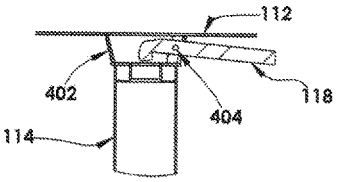
FIG. 37 is a detail rear elevation view of the mainframe component of the first embodiment of the stool, showing Detail C of FIG. 36, in accordance with implementations of this disclosure.
Figure 38:
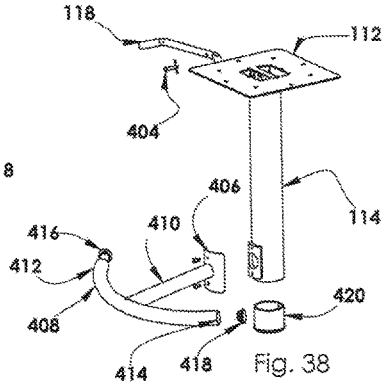
FIG. 38 is an exploded perspective view of the mainframe component of the first embodiment of the stool in accordance with implementations of this disclosure.
Figure 39:
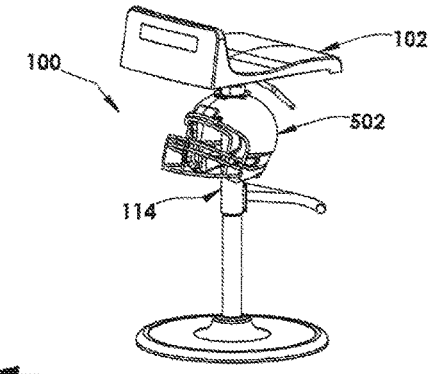
FIG. 39 is a rear perspective view of the first embodiment of the stool, showing the first embodiment of the seat and a first embodiment of a three dimensional ornamental figure, in accordance with implementations of this disclosure.
Figure 40:
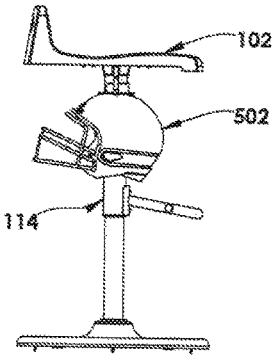
FIG. 40 is a right side elevation view of the first embodiment of the stool, showing the first embodiment of the seat and the first embodiment of a three dimensional ornamental figure, in accordance with implementations of this disclosure.
Figure 41:
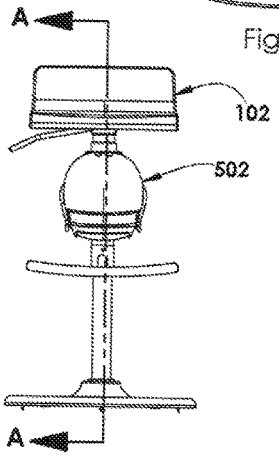
FIG. 41 is a front elevation view of the first embodiment of the stool, showing the first embodiment of the seat and the first embodiment of a three dimensional ornamental figure, in accordance with implementations of this disclosure.
Figure 42:
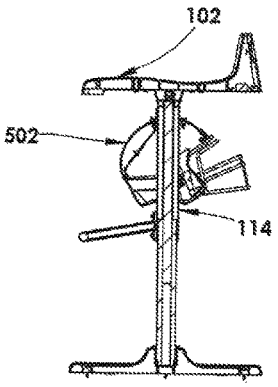
FIG. 42 is a cross-sectional view of the first embodiment of the stool taken along line A-A of FIG. 41, showing the first embodiment of the seat and the first embodiment of a three dimensional ornamental figure, in accordance with implementations of this disclosure.
Figure 43:
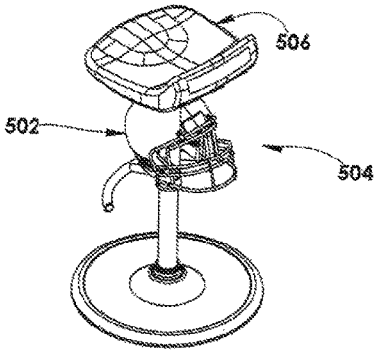
FIG. 43 is a top perspective view of the first embodiment of the stool, showing a prior art seat and the first embodiment of a three dimensional ornamental figure, in accordance with implementations of this disclosure.
Figure 44:
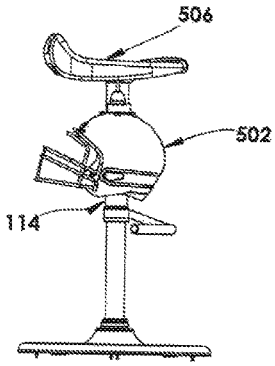
FIG. 44 is a right side elevation view of the first embodiment of the stool, showing the prior art seat and the first embodiment of a three dimensional ornamental figure, in accordance with implementations of this disclosure.
Figure 45:
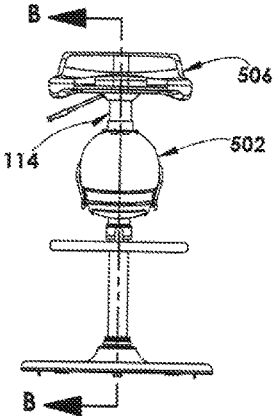
FIG. 45 is a front elevation view of the first embodiment of the stool, showing the prior art seat and the first embodiment of a three dimensional ornamental figure, in accordance with implementations of this disclosure.
Figure 46:
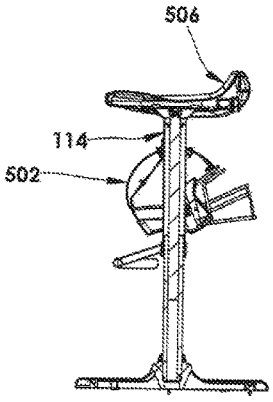
FIG. 46 is a cross-sectional view of the first embodiment of the stool taken along line B-B of FIG. 45, showing the prior art seat and the first embodiment of a three dimensional ornamental figure, in accordance with implementations of this disclosure.
Figure 47:
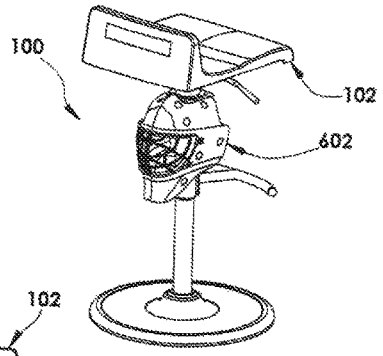
FIG. 47 is a rear perspective view of the first embodiment of the stool, showing the first embodiment of the seat and a second embodiment of a three dimensional ornamental figure, in accordance with implementations of this disclosure.
Figure 48:
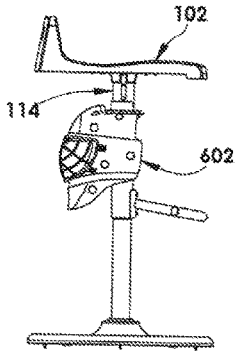
FIG. 48 is a right side elevation view of the first embodiment of the stool, showing the first embodiment of the seat and the second embodiment of a three dimensional ornamental figure, in accordance with implementations of this disclosure.
Figure 49:
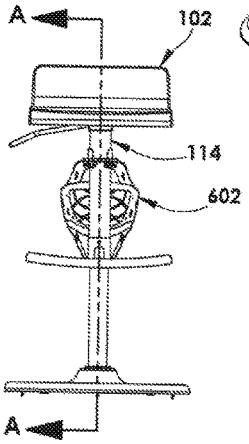
FIG. 49 is a front elevation view of the first embodiment of the stool, showing the first embodiment of the seat and the second embodiment of a three dimensional ornamental figure, in accordance with implementations of this disclosure.
Figure 50:
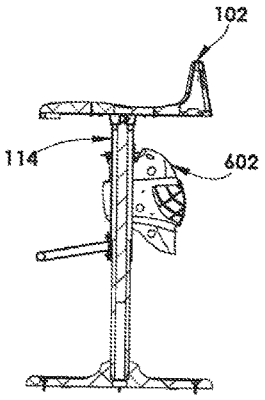
FIG. 50 is a cross-sectional view of the first embodiment of the stool taken along line A-A of FIG. 49, showing the first embodiment of the seat and the second embodiment of a three dimensional ornamental figure, in accordance with implementations of this disclosure.
Figure 51:
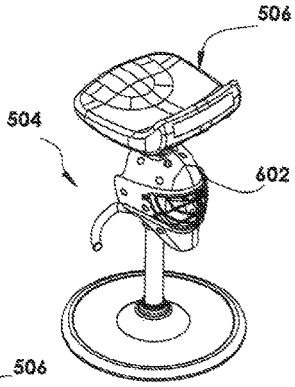
FIG. 51 is a top perspective view of the first embodiment of the stool, showing the prior art seat and the second embodiment of a three dimensional ornamental figure, in accordance with implementations of this disclosure.
Figure 52:
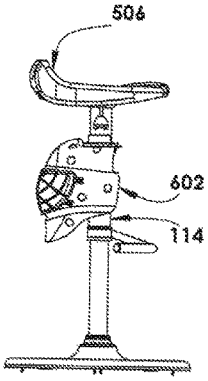
FIG. 52 is a right side elevation view of the first embodiment of the stool, showing the prior art seat and the second embodiment of a three dimensional ornamental figure, in accordance with implementations of this disclosure.
Figure 53:
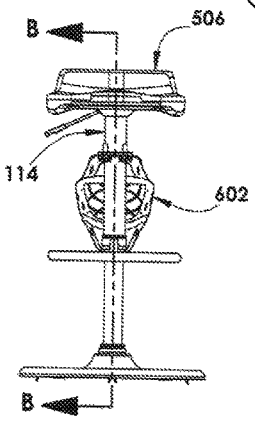
FIG. 53 is a front elevation view of the first embodiment of the stool, showing the prior art seat and the second embodiment of a three dimensional ornamental figure, in accordance with implementations of this disclosure.
Figure 54:
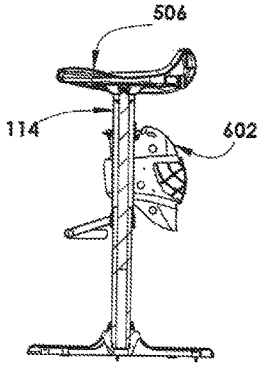
FIG. 54 is a cross-sectional view of the first embodiment of the stool taken along line B-B of FIG. 53, showing the prior art seat and the second embodiment of a three dimensional ornamental figure, in accordance with implementations of this disclosure.
Figure 55:
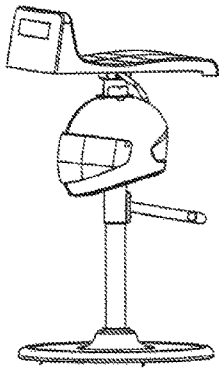
FIG. 55 is a rear perspective view of the first embodiment of the stool, showing the first embodiment of the seat and a third embodiment of a three dimensional ornamental figure, in accordance with implementations of this disclosure.
Figure 56:
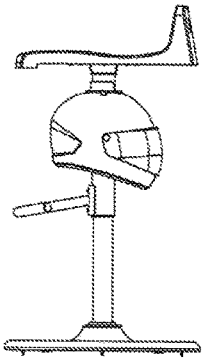
FIG. 56 is a left side elevation view of the first embodiment of the stool, showing the first embodiment of the seat and the third embodiment of a three dimensional ornamental figure, in accordance with implementations of this disclosure.
Figure 57:
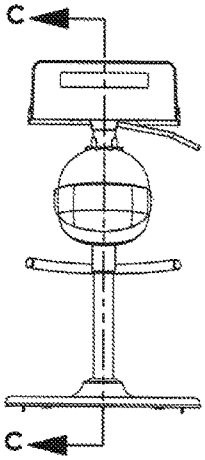
FIG. 57 is a rear elevation view of the first embodiment of the stool, showing the first embodiment of the seat and the third embodiment of a three dimensional ornamental figure, in accordance with implementations of this disclosure.
Figure 58:
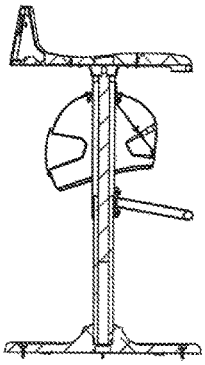
FIG. 58 is a cross-sectional view of the first embodiment of the stool taken along line C-C of FIG. 57, showing the first embodiment of the seat and the third embodiment of a three dimensional ornamental figure, in accordance with implementations of this disclosure.
Figure 59:
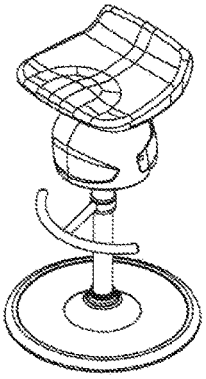
FIG. 59 is a top perspective view of the first embodiment of the stool, showing the prior art seat and the third embodiment of a three dimensional ornamental figure, in accordance with implementations of this disclosure.
Figure 60:
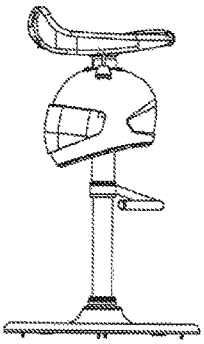
FIG. 60 is a right side elevation view of the first embodiment of the stool, showing the prior art seat and the third embodiment of a three dimensional ornamental figure, in accordance with implementations of this disclosure.
Figure 61:
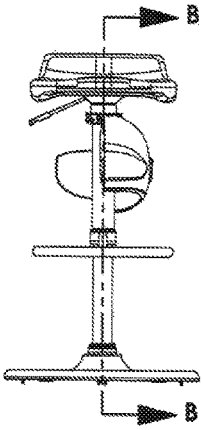
FIG. 61 is a front elevation view of the first embodiment of the stool, showing the prior art seat and the third embodiment of a three dimensional ornamental figure, in accordance with implementations of this disclosure.
Figure 62:
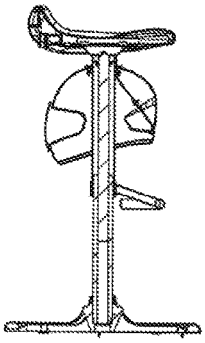
FIG. 62 is a cross-sectional view of the first embodiment of the stool taken along line B-B of FIG. 61, showing the prior art seat and the third embodiment of a three dimensional ornamental figure, in accordance with implementations of this disclosure.
Figure 63:
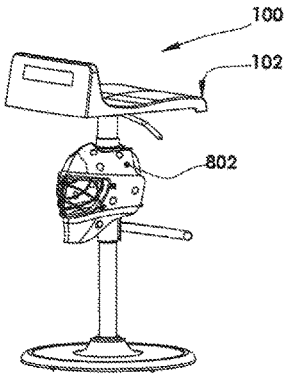
FIG. 63 is a rear perspective view of the first embodiment of the stool, showing the first embodiment of the seat and a fourth embodiment of a three dimensional ornamental figure, in accordance with implementations of this disclosure.
Figure 64:
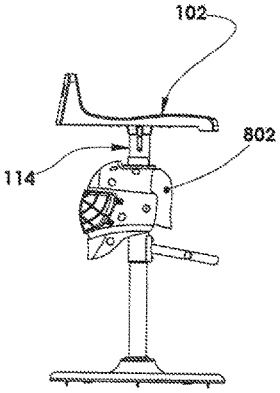
FIG. 64 is a right side elevation view of the first embodiment of the stool, showing the first embodiment of the seat and the fourth embodiment of a three dimensional ornamental figure, in accordance with implementations of this disclosure.
Figure 65:
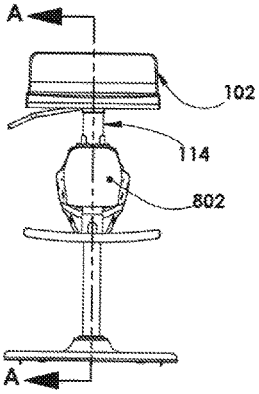
FIG. 65 is a front elevation view of the first embodiment of the stool, showing the first embodiment of the seat and the fourth embodiment of a three dimensional ornamental figure, in accordance with implementations of this disclosure.
Figure 66:
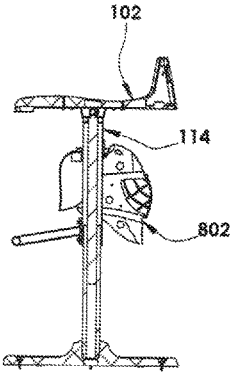
FIG. 66 is a cross-sectional view of the first embodiment of the stool taken along line A-A of FIG. 65, showing the first embodiment of the seat and the fourth embodiment of a three dimensional ornamental figure, in accordance with implementations of this disclosure.
Figure 67:
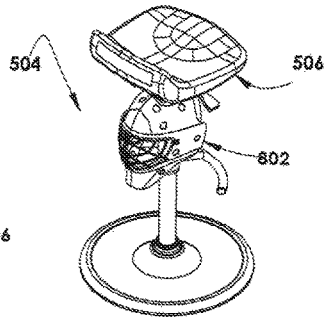
FIG. 67 is a top perspective view of the first embodiment of the stool, showing the prior art seat and the fourth embodiment of a three dimensional ornamental figure, in accordance with implementations of this disclosure.
Figure 68:
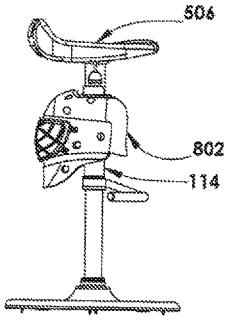
FIG. 68 is a right side elevation view of the first embodiment of the stool, showing the prior art seat and the fourth embodiment of a three dimensional ornamental figure, in accordance with implementations of this disclosure.
Figure 69:
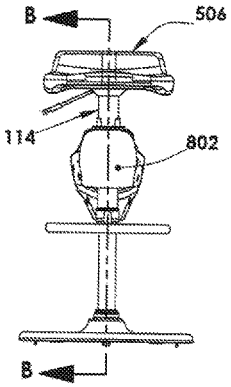
FIG. 69 is a front elevation view of the first embodiment of the stool, showing the prior art seat and the fourth embodiment of a three dimensional ornamental figure, in accordance with implementations of this disclosure.
Figure 70:
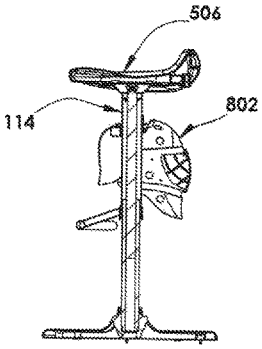
FIG. 70 is a cross-sectional view of the first embodiment of the stool taken along line B-B of FIG. 69, showing the prior art seat and the fourth embodiment of a three dimensional ornamental figure, in accordance with implementations of this disclosure.
Figure 71:
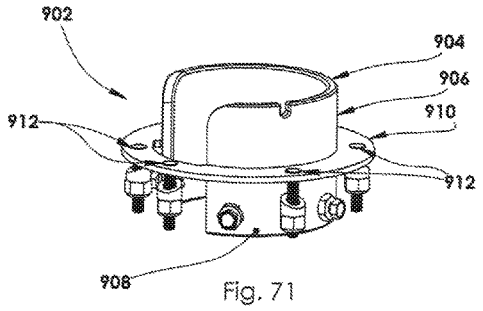
FIG. 71 is a perspective view of an ornamental figure support bracket of the first embodiment of the stool in accordance with implementations of this disclosure.
Figure 72:
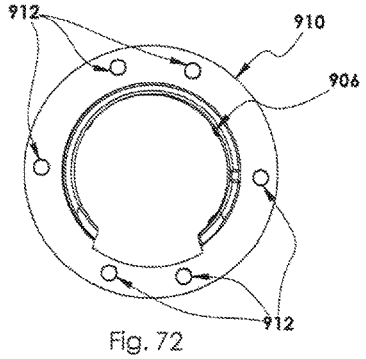
FIG. 72 is a top elevation view of the ornamental figure support bracket of the first embodiment of the stool in accordance with implementations of this disclosure.
Figure 73:
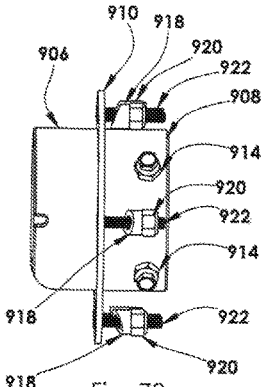
FIG. 73 is a side elevation view of the ornamental figure support bracket of the first embodiment of the stool taken along line A-A of FIG. 71 in accordance with implementations of this disclosure.
Figure 74:
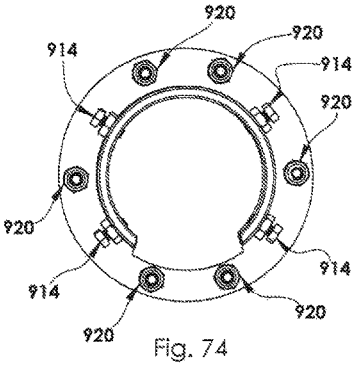
FIG. 74 is a bottom elevation view of the ornamental figure support bracket of the first embodiment of the stool in accordance with implementations of this disclosure.
Figure 75:
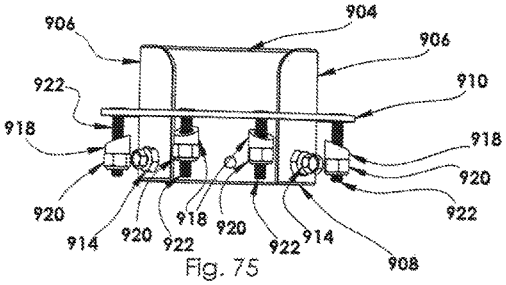
FIG. 75 is a front elevation view of the ornamental figure support bracket of the first embodiment of the stool in accordance with implementations of this disclosure.
Figure 76:
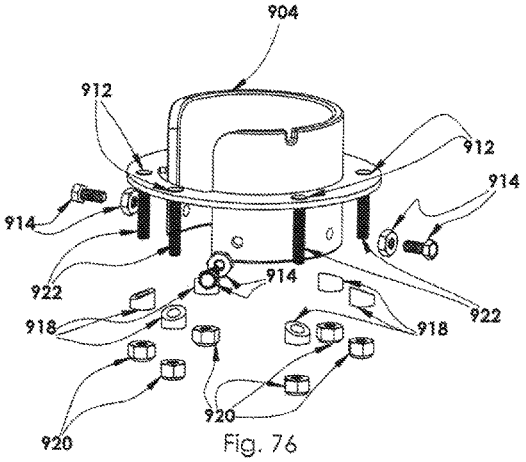
FIG. 76 is an exploded perspective view of the ornamental figure support bracket of the first embodiment of the stool in accordance with implementations of this disclosure.
Figure 77:
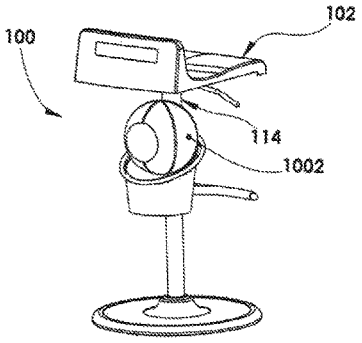
FIG. 77 is a rear perspective view of the first embodiment of the stool, showing the first embodiment of the seat and a fifth embodiment of a three dimensional ornamental figure, in accordance with implementations of this disclosure.
Figure 78:
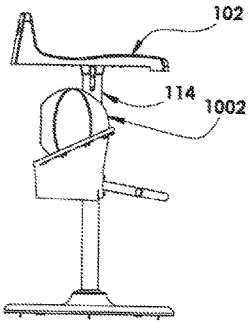
FIG. 78 is a right side elevation view of the first embodiment of the stool, showing the first embodiment of the seat and the fifth embodiment of a three dimensional ornamental figure, in accordance with implementations of this disclosure.
Figure 79:
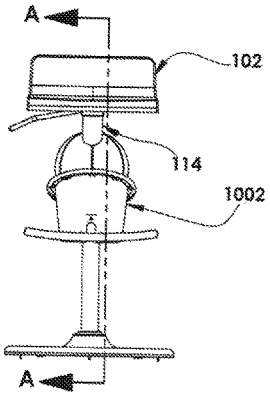
FIG. 79 is a front elevation view of the first embodiment of the stool, showing the first embodiment of the seat and the fifth embodiment of a three dimensional ornamental figure, in accordance with implementations of this disclosure.
Figure 80:
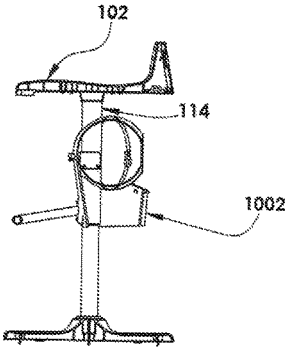
FIG. 80 is a cross-sectional view of the first embodiment of the stool taken along line A-A of FIG. 79, showing the first embodiment of the seat and the fifth embodiment of a three dimensional ornamental figure, in accordance with implementations of this disclosure.
Figure 81:
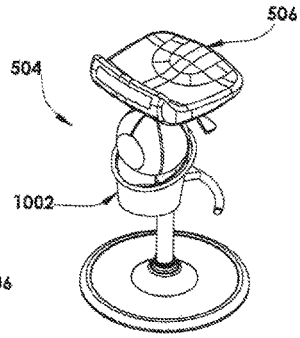
FIG. 81 is a top perspective view of the first embodiment of the stool, showing the prior art seat and the fifth embodiment of a three dimensional ornamental figure, in accordance with implementations of this disclosure.
Figure 82:
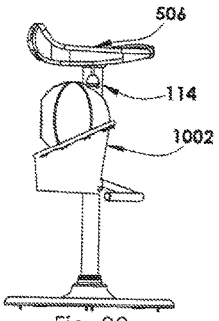
FIG. 82 is a right side elevation view of the first embodiment of the stool, showing the prior art seat and the fifth embodiment of a three dimensional ornamental figure, in accordance with implementations of this disclosure.
Figure 83:
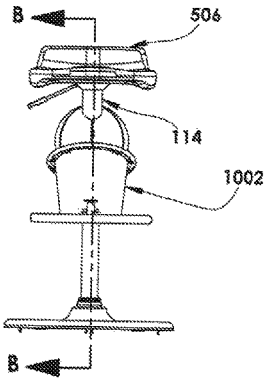
FIG. 83 is a front elevation view of the first embodiment of the stool, showing the prior art seat and the fifth embodiment of a three dimensional ornamental figure, in accordance with implementations of this disclosure.
Figure 84:
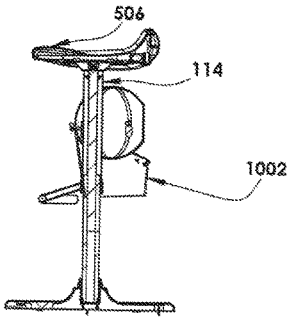
FIG. 84 is a cross-sectional view of the first embodiment of the stool taken along line B-B of FIG. 83, showing the prior art seat and the fifth embodiment of a three dimensional ornamental figure, in accordance with implementations of this disclosure.
Figure 85:
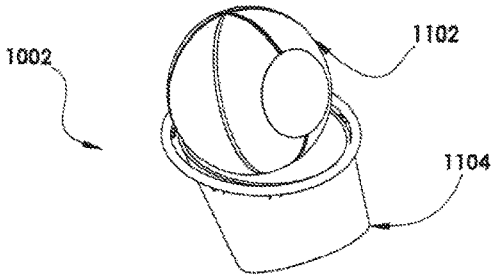
FIG. 85 is a perspective view of the fifth embodiment of a three dimensional ornamental figure of the first embodiment of the stool in accordance with implementations of this disclosure.
Figure 86:
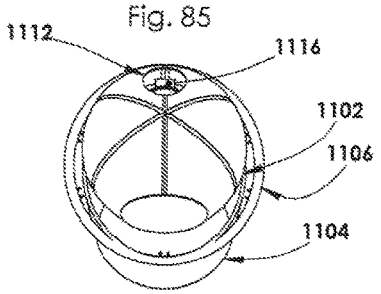
FIG. 86 is a top elevation view of the fifth embodiment of a three dimensional ornamental figure of the first embodiment of the stool in accordance with implementations of this disclosure.
Figure 87:
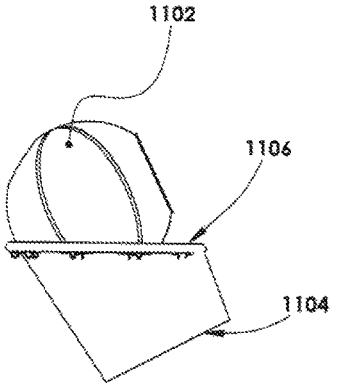
FIG. 87 is a left side elevation view of the fifth embodiment of a three dimensional ornamental figure of the first embodiment of the stool in accordance with implementations of this disclosure.
Figure 88:
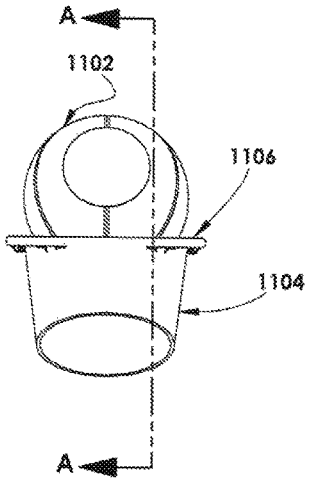
FIG. 88 is a front elevation view of the fifth embodiment of a three dimensional ornamental figure of the first embodiment of the stool in accordance with implementations of this disclosure.
Figure 89:
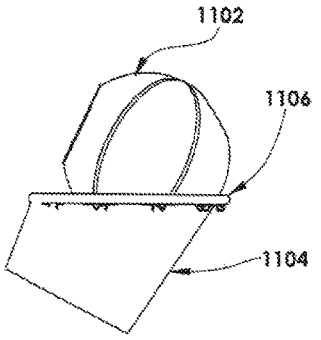
FIG. 89 is a right side elevation view of the fifth embodiment of a three dimensional ornamental figure of the first embodiment of the stool in accordance with implementations of this disclosure.
Figure 90:
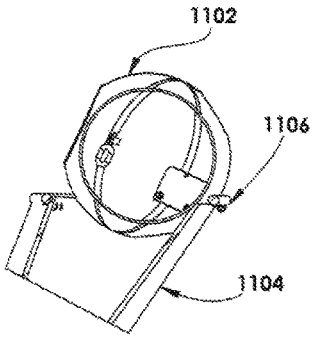
FIG. 90 is a cross-sectional view of the fifth embodiment of a three dimensional ornamental figure of the first embodiment of the stool taken along line A-A of FIG. 88 in accordance with implementations of this disclosure.
Figure 91:
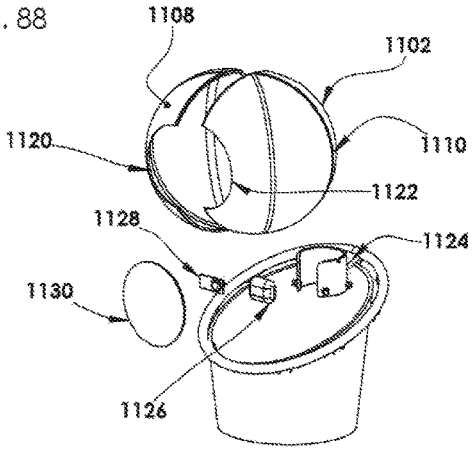
FIG. 91 is an exploded perspective view of the fifth embodiment of a three dimensional ornamental figure of the first embodiment of the stool in accordance with implementations of this disclosure.
Figure 92:
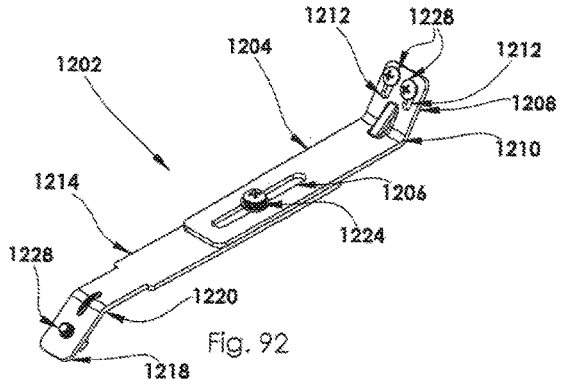
FIG. 92 is a perspective view of an adjustable rear support bracket of the first embodiment of the stool in accordance with implementations of this disclosure.
Figure 93:
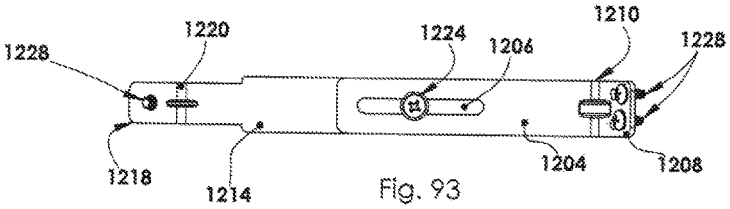
FIG. 93 is a top elevation view of the adjustable rear support bracket of the first embodiment of the stool in accordance with implementations of this disclosure.
Figure 94:
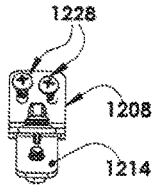
FIG. 94 is a front elevation view of the adjustable rear support bracket of the first embodiment of the stool in accordance with implementations of this disclosure.
Figure 95:
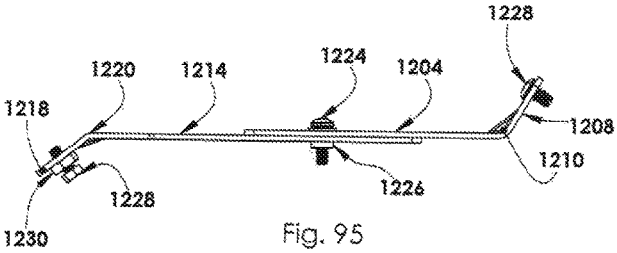
FIG. 95 is a side elevation view of the adjustable rear support bracket of the first embodiment of the stool in accordance with implementations of this disclosure.
Figure 96:
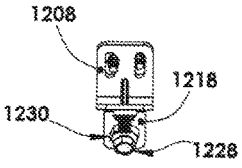
FIG. 96 is a rear elevation view of the adjustable rear support bracket of the first embodiment of the stool in accordance with implementations of this disclosure.
Figure 97:
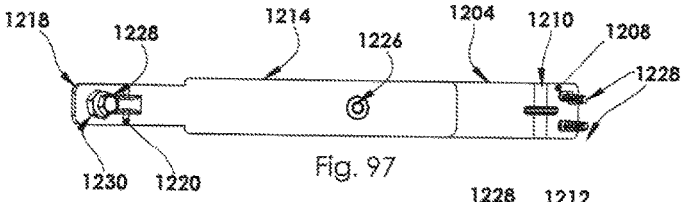
FIG. 97 is a bottom elevation view of the adjustable rear support bracket of the first embodiment of the stool in accordance with implementations of this disclosure.
Figure 98:
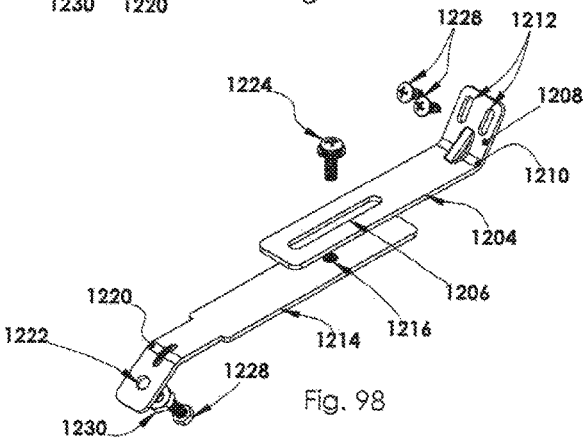
FIG. 98 is an exploded perspective view of the adjustable rear support bracket of the first embodiment of the stool in accordance with implementations of this disclosure.
Figure 99:
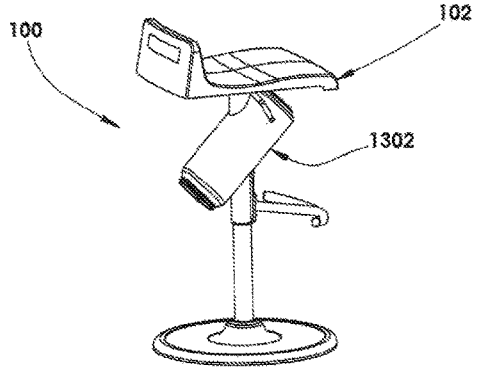
FIG. 99 is a rear perspective view of the first embodiment of the stool, showing the first embodiment of the seat and a sixth embodiment of a three dimensional ornamental figure, in accordance with implementations of this disclosure.
Figure 100:
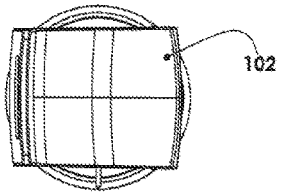
FIG. 100 is a top elevation view of the first embodiment of the stool, showing the first embodiment of the seat, in accordance with implementations of this disclosure.
Figure 101:
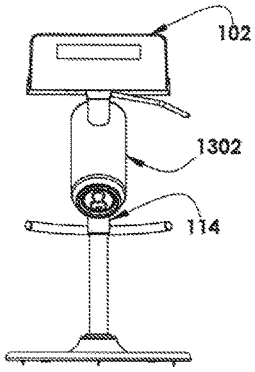
FIG. 101 is a rear elevation view of the first embodiment of the stool, showing the first embodiment of the seat and the sixth embodiment of a three dimensional ornamental figure, in accordance with implementations of this disclosure.
Figure 102:
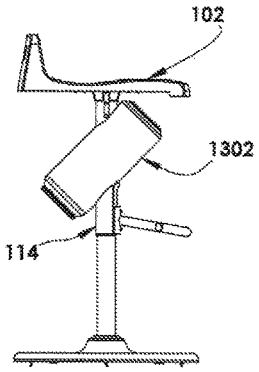
FIG. 102 is a right side elevation view of the first embodiment of the stool, showing the first embodiment of the seat and the sixth embodiment of a three dimensional ornamental figure, in accordance with implementations of this disclosure.
Figure 103:
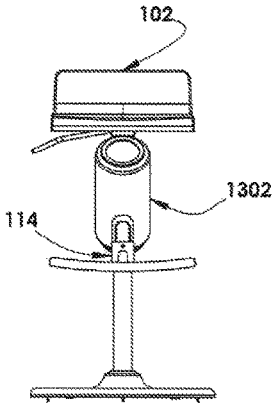
FIG. 103 is a front elevation view of the first embodiment of the stool, showing the first embodiment of the seat and the sixth embodiment of a three dimensional ornamental figure, in accordance with implementations of this disclosure.
Figure 104:
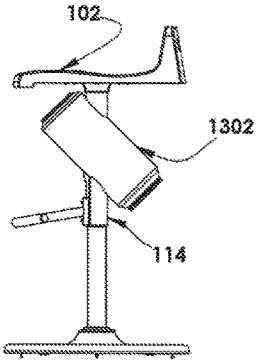
FIG. 104 is a left side elevation view of the first embodiment of the stool, showing the first embodiment of the seat and the sixth embodiment of a three dimensional ornamental figure, in accordance with implementations of this disclosure.
Figure 105:
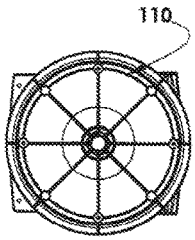
FIG. 105 is a bottom elevation view of the first embodiment of the stool in accordance with implementations of this disclosure.
Figure 106:
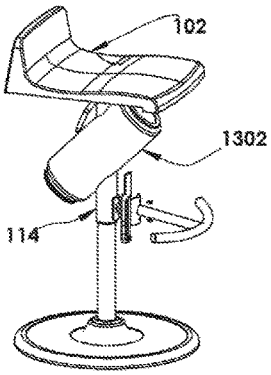
FIG. 106 is a side perspective view of the first embodiment of the stool, showing the first embodiment of the seat and the sixth embodiment of a three dimensional ornamental figure, in accordance with implementations of this disclosure.
Figure 107:
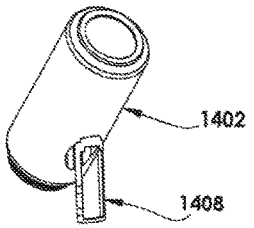
FIG. 107 is a front perspective view of the sixth embodiment of a three dimensional ornamental figure of the first embodiment of the stool with the first embodiment of the seat in accordance with implementations of this disclosure.
Figure 108:
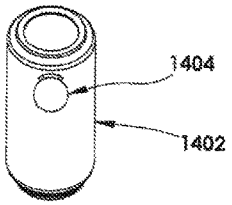
FIG. 108 is a rear elevation view of the sixth embodiment of a three dimensional ornamental figure of the first embodiment of the stool with the first embodiment of the seat in accordance with implementations of this disclosure.
Figure 109:
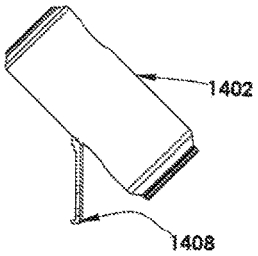
FIG. 109 is a left side elevation view of the sixth embodiment of a three dimensional ornamental figure of the first embodiment of the stool with the first embodiment of the seat in accordance with implementations of this disclosure.
Figure 110:
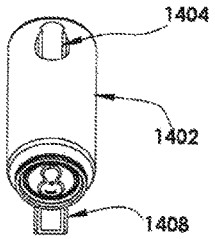
FIG. 110 is a front perspective view of the sixth embodiment of a three dimensional ornamental figure of the first embodiment of the stool with the first embodiment of the seat in accordance with implementations of this disclosure.
Figure 111:
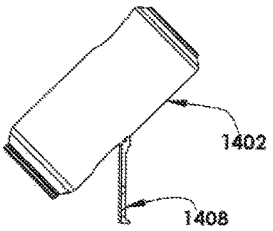
FIG. 111 is a right side elevation view of the sixth embodiment of a three dimensional ornamental figure of the first embodiment of the stool with the first embodiment of the seat in accordance with implementations of this disclosure.
Figure 112:
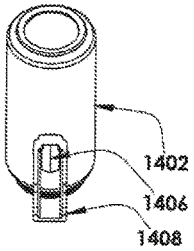
FIG. 112 is a rear perspective view of the sixth embodiment of a three dimensional ornamental figure of the first embodiment of the stool with the first embodiment of the seat in accordance with implementations of this disclosure.
Figure 113:
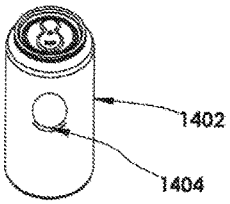
FIG. 113 is a rear elevation view in an inverted position of the sixth embodiment of a three dimensional ornamental figure of the first embodiment of the stool with the first embodiment of the seat in accordance with implementations of this disclosure.
Figure 114:
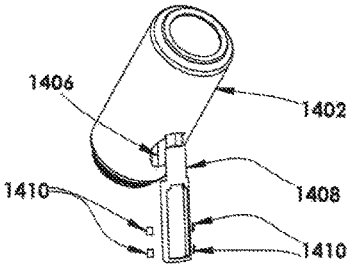
FIG. 114 is an exploded perspective view of the sixth embodiment of a three dimensional ornamental figure of the first embodiment of the stool with the first embodiment of the seat in accordance with implementations of this disclosure.
Figure 115:
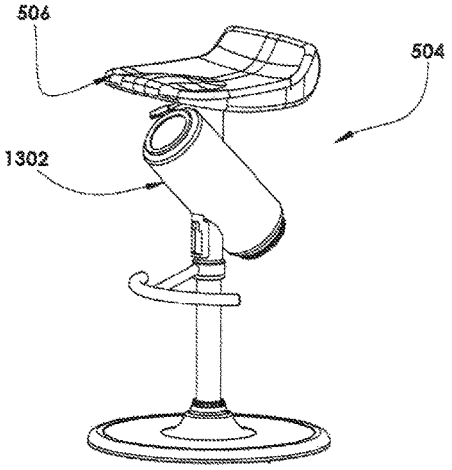
FIG. 115 is a side perspective view of the first embodiment of the stool, showing the prior art seat and the sixth embodiment of a three dimensional ornamental figure, in accordance with implementations of this disclosure.
Figure 116:
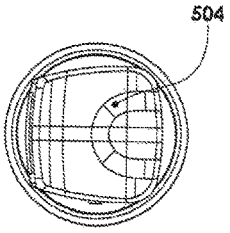
FIG. 116 is a top elevation view of the first embodiment of the stool, showing the prior art seat, in accordance with implementations of this disclosure.
Figure 117:
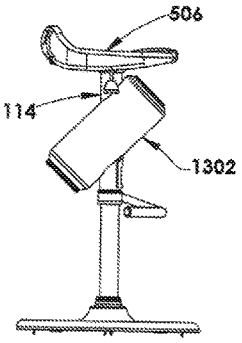
FIG. 117 is a right side elevation view of the first embodiment of the stool, showing the prior art seat and the sixth embodiment of a three dimensional ornamental figure in accordance with implementations of this disclosure.
Figure 118:
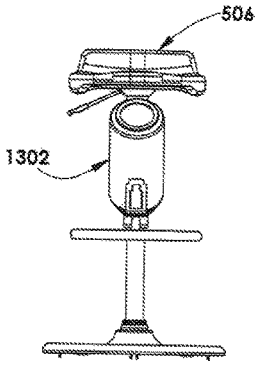
FIG. 118 is a front elevation view of the first embodiment of the stool, showing the prior art seat and the sixth embodiment of a three dimensional ornamental figure in accordance with implementations of this disclosure.
Figure 119:
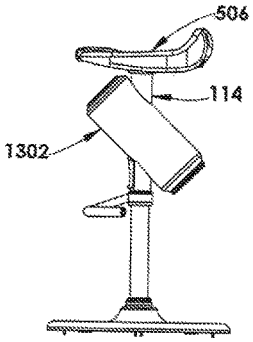
Figure 120:
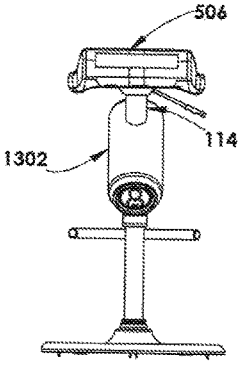
Figure 121:
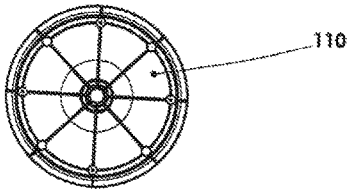
Figure 122:
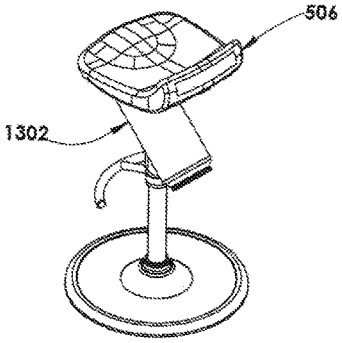
Figure 123:
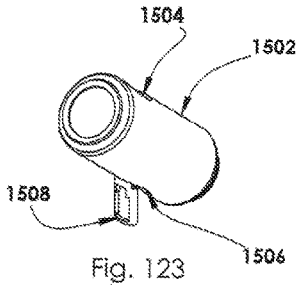
Figure 124:
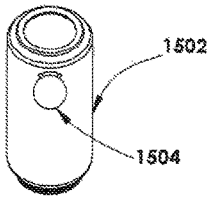
Figure 125:
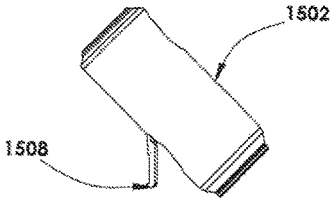
Figure 126:
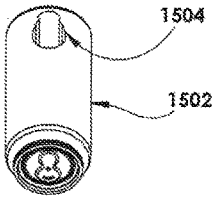
Figure 127:
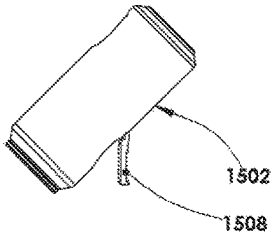
Figure 128:
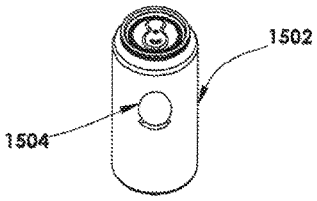
Figure 129:
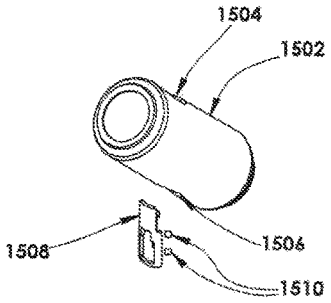
Figure 130:
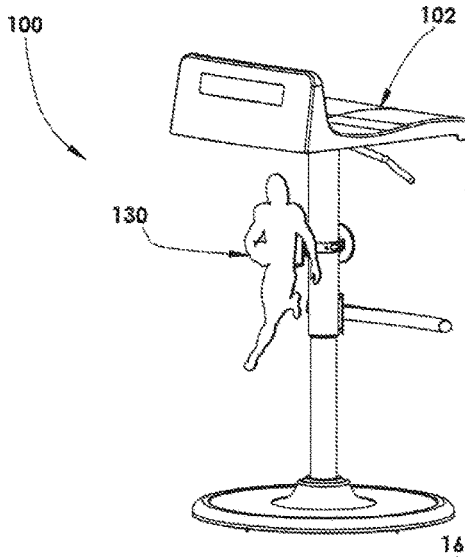

Referring to FIGS. 130-141, various mounting bracket assemblies for the first embodiment of stool 100 with seat 102 are shown that can be used to fasten the silhouette of a themed FIG. 130, shown in FIG. 130, and/or the three dimensional ornamental figure 128, shown in FIG. 131, to the first embodiment of stool 100 with seat 102.

A first embodiment of a mounting bracket assembly 1602, shown in FIG. 132, includes an annular or generally cylindrical bracket 1604 configured to be secured around mainframe shaft 114, a round decorative graphic 1606 on a side opposite the silhouette of a themed FIG. 130 and/or the three dimensional ornamental figure 128, and a mounting bracket 1608 configured to secure the assembly 1602 to the silhouette of a themed FIG. 130 and/or the three dimensional ornamental figure 128, the mounting bracket 1608 including a aperture 1610 that holds an interchangeable decorative graphic 1612 (FIG. 178) on a side adjacent the silhouette of a themed FIG. 130 and/or the three dimensional ornamental figure 128. The round decorative graphic 1606 is round in this illustrated embodiment but in other embodiments the decorative graphic 1606 can be of various shapes.

A second embodiment of a mounting bracket assembly 1614, shown in FIG. 133, includes an annular or generally cylindrical bracket 1616 configured to be secured around mainframe shaft 114 and a mounting bracket 1618 configured to secure the assembly 1614 to the silhouette of a themed FIG. 130 and/or the three dimensional ornamental figure 128, the mounting bracket 1618 including a aperture 1620 that holds an interchangeable decorative graphic 1622 (not shown) on a side adjacent the silhouette of a themed FIG. 130 and/or the three dimensional ornamental figure 128.

A third embodiment of a mounting bracket assembly 1624, shown in FIG. 134, includes an annular or generally cylindrical bracket 1626 configured to be secured around mainframe shaft 114 and a web-shaped arm 1628 extending laterally from the cylindrical bracket 1626, the arm 1628 converging at a distal end 1630 adjacent the silhouette of a themed FIG. 130 and/or the three dimensional ornamental figure 128 and configured to secure the assembly 1624 to the silhouette of a themed FIG. 130 and/or the three dimensional ornamental figure 128.

A fourth embodiment of a mounting bracket assembly 1632, shown in FIG. 135, includes an annular or cylindrical bracket 1634 configured to be secured around mainframe shaft 114, a round decorative graphic 1636 on a side opposite the silhouette of a themed FIG. 130 and/or the three dimensional ornamental figure 128, and a mounting bracket 1638 configured to secure the assembly 1632 to the silhouette of a themed FIG. 130 and/or the three dimensional ornamental figure 128, the mounting bracket 1638 including a aperture 1640 that holds an interchangeable decorative graphic 1642 (FIG. 203) on a side adjacent the silhouette of a themed FIG. 130 and/or the three dimensional ornamental figure 128. The cylindrical bracket 1634 includes a hinge 1643 (FIGS. 198 & 203) adjacent the round decorative graphic 1636. The round decorative graphic 1636 is round in this illustrated embodiment but in other embodiments the decorative graphic 1636 can be of various shapes.

A fifth embodiment of a mounting bracket assembly 1644, shown in FIG. 136, includes a plurality of annular or generally cylindrical brackets 1646 configured to be secured around mainframe shaft 114, a round decorative graphic 1647 on a side opposite the silhouette of a themed FIG. 130 and/or the three dimensional ornamental figure 128, and a mounting bracket 1648 configured to secure the assembly 1644 to the silhouette of a themed FIG. 130 and/or the three dimensional ornamental figure 128. A plurality of arms 1649 laterally extend from the plurality of cylindrical brackets 1646 to the mounting bracket 1648. The round decorative graphic 1647 is round in this illustrated embodiment but in other embodiments the decorative graphic 1647 can be of various shapes.

A sixth embodiment of a mounting bracket assembly 1650, shown in FIG. 137, includes a plurality of annular or generally cylindrical brackets 1652 configured to be secured around mainframe shaft 114 and a mounting bracket 1654 configured to secure the assembly 1650 to the silhouette of a themed FIG. 130 and/or the three dimensional ornamental figure 128. A plurality of arms 1655 laterally extend from the plurality of cylindrical brackets 1652 to the mounting bracket 1654.

A seventh embodiment of a mounting bracket assembly 1656, shown in FIG. 138, includes an annular or cylindrical bracket 1658 configured to be secured around mainframe shaft 114, a round decorative graphic 1660 on a side opposite the silhouette of a themed FIG. 130 and/or the three dimensional ornamental figure 128, and a mounting bracket 1662 configured to secure the assembly 1656 to the silhouette of a themed FIG. 130 and/or the three dimensional ornamental figure 128, the mounting bracket 1662 including a aperture 1664 that holds an interchangeable decorative graphic 1666 (FIG. 196) on a side adjacent the silhouette of a themed FIG. 130 and/or the three dimensional ornamental figure 128. The cylindrical bracket 1658 includes a hinge 1668 (FIGS. 158, 163, 166, 171, 192, and 196) adjacent the round decorative graphic 1660. The round decorative graphic 1660 is round in this illustrated embodiment but in other embodiments the decorative graphic 1660 can be of various shapes.

An eighth embodiment of a mounting bracket assembly 1670, shown in FIG. 139, includes a plurality of annular or generally cylindrical brackets 1672 fastened to a round decorative graphic 1674 on a side opposite the silhouette of a themed FIG. 130 and/or the three dimensional ornamental figure 128, the plurality of cylindrical brackets 1672 configured to be secured around mainframe shaft 114. The plurality of cylindrical brackets 1672 are configured to be secured to the silhouette of a themed FIG. 130 and/or the three dimensional ornamental FIG. 128 on a side opposite the round decorative graphic 1674. The round decorative graphic 1674 is round in this illustrated embodiment but in other embodiments the decorative graphic 1674 can be of various shapes.

A ninth embodiment of a mounting bracket assembly 1676, shown in FIG. 140, includes a top attachment bracket 1678 and a bottom attachment bracket 1680 configured to be secured to mainframe shaft 114 and a mounting bracket 1682 configured to secure the assembly 1676 to the silhouette of a themed FIG. 130 and/or the three dimensional ornamental figure 128. A laterally extending shaft 1684 extends from the top attachment bracket 1678 to the top of the mounting bracket 1682 and a laterally extending shaft 1686 extends from the bottom attachment bracket 1680 to the bottom of the mounting bracket 1682.

A tenth embodiment of mounting bracket assembly 1688, shown in FIG. 141, includes an attachment bracket 1690 configured to be secured to mainframe shaft 114 and a mounting bracket 1692 configured to secure the assembly 1688 to the silhouette of a themed FIG. 130 and/or the three dimensional ornamental figure 128. The mounting bracket 1692 is rotatable about a laterally extending shaft 1694 (FIGS. 212, 213, 215, and 217) that extends from the attachment bracket 1690 to the mounting bracket 1692.

Referring to FIGS. 142-156, various mounting bracket assemblies for the second embodiment of stool 502 with seat 504 are shown that can be used to fasten the silhouette of a themed FIG. 130, shown in FIG. 142, and/or the three dimensional ornamental figure 128, shown in FIG. 143, to the second embodiment of stool 502 with seat 504.

A first embodiment of a mounting bracket assembly 1702, shown in FIG. 144, includes an annular or cylindrical bracket 1704 configured to be secured around mainframe shaft 114, a round decorative graphic 1706 on a side opposite the silhouette of a themed FIG. 130 and/or the three dimensional ornamental figure 128, and a mounting bracket 1708 configured to secure the assembly 1702 to the silhouette of a themed FIG. 130 and/or the three dimensional ornamental figure 128, the mounting bracket 1708 including a aperture 1710 that holds an interchangeable decorative graphic 1712 (not shown) on a side adjacent the silhouette of a themed FIG. 130 and/or the three dimensional ornamental figure 128. The cylindrical bracket 1704 includes a hinge 1714 (not shown) adjacent the round decorative graphic 1706. The round decorative graphic 1706 is round in this illustrated embodiment but in other embodiments the decorative graphic 1706 can be of various shapes.

A second embodiment of a mounting bracket assembly 1716, shown in FIG. 145, includes an annular or cylindrical bracket 1718 configured to be secured around mainframe shaft 114 and a mounting bracket 1720 configured to secure the assembly 1716 to the silhouette of a themed FIG. 130 and/or the three dimensional ornamental figure 128, the mounting bracket 1720 including a aperture 1722 that holds an interchangeable decorative graphic 1724 (not shown) on a side adjacent the silhouette of a themed FIG. 130 and/or the three dimensional ornamental figure 128.

A third embodiment of a mounting bracket assembly 1726, shown in FIG. 146, includes an annular or generally cylindrical bracket 1728 configured to be secured around mainframe shaft 114 and a web-shaped arm 1730 extending laterally from the cylindrical bracket 1728, the arm 1730 converging at a distal end 1732 adjacent the silhouette of a themed FIG. 130 and/or the three dimensional ornamental figure 128 and configured to secure the assembly 1726 to the silhouette of a themed FIG. 130 and/or the three dimensional ornamental figure 128.

A fourth embodiment of a mounting bracket assembly 1734, shown in FIG. 147, includes an annular or cylindrical bracket 1736 configured to be secured around mainframe shaft 114, a round decorative graphic 1738 on a side opposite the silhouette of a themed FIG. 130 and/or the three dimensional ornamental figure 128, and a mounting bracket 1740 configured to secure the assembly 1734 to the silhouette of a themed FIG. 130 and/or the three dimensional ornamental figure 128, the mounting bracket 1740 including a aperture 1742 that holds an interchangeable decorative graphic 1744 (FIG. 203) on a side adjacent the silhouette of a themed FIG. 130 and/or the three dimensional ornamental figure 128. The cylindrical bracket 1736 includes a hinge 1746 (FIGS. 198 and 203) adjacent the round decorative graphic 1738. The round decorative graphic 1738 is round in this illustrated embodiment but in other embodiments the decorative graphic 1738 can be of various shapes.

A fifth embodiment of a mounting bracket assembly 1748, shown in FIG. 148, includes a top attachment bracket 1750 and a bottom attachment bracket 1752 configured to be secured to mainframe shaft 114 and a mounting bracket 1754 configured to secure the assembly 1748 to the silhouette of a themed FIG. 130 and/or the three dimensional ornamental figure 128. A laterally extending shaft 1756 extends from the top attachment bracket 1750 to the top of the mounting bracket 1754 and a laterally extending shaft 1758 extends from the bottom attachment bracket 1752 to the bottom of the mounting bracket 1754.

A sixth embodiment of a mounting bracket assembly 1760, shown in FIG. 149, includes a plurality of annular or generally cylindrical brackets 1762 configured to be secured around mainframe shaft 114, a round decorative graphic 1764 on a side opposite the silhouette of a themed FIG. 130 and/or the three dimensional ornamental figure 128, and a mounting bracket 1766 configured to secure the assembly 1760 to the silhouette of a themed FIG. 130 and/or the three dimensional ornamental figure 128. A plurality of arms 1768 laterally extend from the plurality of cylindrical brackets 1762 to the mounting bracket 1766. The round decorative graphic 1764 is round in this illustrated embodiment but in other embodiments the decorative graphic 1764 can be of various shapes.

A seventh embodiment of mounting bracket assembly 1770, shown in FIG. 150, includes an attachment bracket 1772 configured to be secured to mainframe shaft 114 and a mounting bracket 1774 configured to secure the assembly 1770 to the silhouette of a themed FIG. 130 and/or the three dimensional ornamental figure 128. The mounting bracket 1774 is rotatable about a laterally extending shaft 1776 (FIGS. 212, 213, 215, and 217) that extends from the attachment bracket 1772 to the mounting bracket 1774.

A eighth embodiment of a mounting bracket assembly 1778, shown in FIG. 151, includes a plurality of annular or cylindrical brackets 1780 configured to be secured around mainframe shaft 114 and a mounting bracket 1782 configured to secure the assembly 1778 to the silhouette of a themed FIG. 130 and/or the three dimensional ornamental figure 128. A plurality of web-shaped arms 1784 laterally extend from the plurality of cylindrical brackets 1780 to the mounting bracket 1782.

An ninth embodiment of a mounting bracket assembly 1786, shown in FIG. 152, includes a plurality of annular or generally cylindrical brackets 1788 fastened to a round decorative graphic 1790 on a side opposite the silhouette of a themed FIG. 130 and/or the three dimensional ornamental figure 128, the plurality of cylindrical brackets 1788 configured to be secured around mainframe shaft 114. The plurality of cylindrical brackets 1788 are also configured to be secured to the silhouette of a themed FIG. 130 and/or the three dimensional ornamental figure 128 on a side opposite the round decorative graphic 1790. The round decorative graphic 1790 is round in this illustrated embodiment but in other embodiments the decorative graphic 1790 can be of various shapes.

A tenth embodiment of a mounting bracket assembly 1792, shown in FIG. 153, includes an annular or cylindrical bracket 1794 configured to be secured around mainframe shaft 114, a round decorative graphic 1796 on a side opposite the silhouette of a themed FIG. 130 and/or the three dimensional ornamental figure 128, and a mounting bracket

1798 configured to secure the assembly 1792 to the silhouette of a themed FIG. 130 and/or the three dimensional ornamental figure 128, the mounting bracket 1798 including a aperture 1800 that holds an interchangeable decorative graphic 1802 (FIG. 196) on a side adjacent the silhouette of a themed FIG. 130 and/or the three dimensional ornamental figure 128. The cylindrical bracket 1794 includes a hinge 1804 (FIGS. 158, 163, 166, 171, 192, and 196) adjacent the round decorative graphic 1796. The round decorative graphic 1796 is round in this illustrated embodiment but in other embodiments the decorative graphic 1796 can be of various shapes.

A eleventh embodiment of a mounting bracket assembly 1806, shown in FIG. 154, includes an annular or generally cylindrical bracket 1808 configured to be secured around mainframe shaft 114 and a mounting bracket 1810 configured to secure the assembly 1806 to the silhouette of a themed FIG. 130 and/or the three dimensional ornamental figure 128, the mounting bracket 1810 including a aperture 1812 that holds an interchangeable decorative graphic 1814 (not shown) on a side adjacent the silhouette of a themed FIG. 130 and/or the three dimensional ornamental figure 128.

A twelfth embodiment of a mounting bracket assembly 1816, shown in FIG. 155, includes a plurality of annular or generally cylindrical brackets 1818 configured to be secured around mainframe shaft 114 and a mounting bracket 1820 configured to secure the assembly 1816 to the silhouette of a themed FIG. 130 and/or the three dimensional ornamental figure 128. A plurality of arms 1822 laterally extend from the plurality of cylindrical brackets 1818 to the mounting bracket 1820.

A thirteenth embodiment of a mounting bracket assembly 1824, shown in FIG. 156, includes an annular or generally cylindrical bracket 1826 configured to be secured around mainframe shaft 114, a round decorative graphic 1828 on a side opposite the silhouette of a themed FIG. 130 and/or the three dimensional ornamental figure 128, and a mounting bracket 1830 configured to secure the assembly 1824 to the silhouette of a themed FIG. 130 and/or the three dimensional ornamental figure 128, the mounting bracket 1830 including a aperture 1832 that holds an interchangeable decorative graphic 1834 (FIG. 178) on a side adjacent the silhouette of a themed FIG. 130 and/or the three dimensional ornamental figure 128. The round decorative graphic 1828 is round in this illustrated embodiment but in other embodiments the decorative graphic 1828 can be of various shapes.

A first embodiment of the silhouette of a themed FIG. 130 is shown with the seventh embodiment of the mounting bracket assembly 1656 of the first embodiment of the stool 100 or the tenth embodiment of the mounting bracket assembly 1792 of the second embodiment of the stool 502 is shown in detail in FIGS. 157-164 and a seventh embodiment of the three dimensional ornamental figure 128, a beverage bottle figure, is shown with the seventh embodiment of the mounting bracket assembly 1656 of the first embodiment of the stool 100 or the tenth embodiment of the mounting bracket assembly 1792 of the second embodiment of the stool 502 is shown in detail in FIGS. 165-172. The cylindrical bracket 1658, 1794 includes a pair of opposing mounting flanges 1902 opposite the hinge 1668, 1804. The pair of opposing mounting flanges 1902 each include a plurality of apertures 1904 (FIG. 196) that each receive a screw 1906 and nut 1908 to fasten the bracket assembly 1656, 1792 to the mainframe shaft 114. The pair of opposing mounting flanges 1902 also receive a shaft 1910 (FIG. 196) extending from the mounting bracket 1662, 1798, the mounting bracket 1662, 1798 rotatable about the shaft 1910. The mounting bracket 1662, 1798 also includes a mounting flange 1912 configured to fasten the bracket assembly 1656, 1792 to the silhouette of a themed FIG. 130. The mounting flange 1912 includes an aperture 1914 at a first end 1916 and an aperture 1918 at a second end 1920. Apertures 1914, 1918 each receive a screws 1922, 1924 that thread into apertures 1926, 1928, respectively, on a back side of the silhouette of a themed FIG. 130, fastening the mounting bracket 1662, 1798 to the silhouette of a themed FIG. 130.

The first embodiment of the mounting bracket assembly 1602 of the first embodiment of the stool 100 or the thirteenth embodiment of the mounting bracket assembly 1824 of the second embodiment of the stool 502 is shown in detail in FIGS. 173-178. The generally cylindrical bracket 1604, 1826 includes an arcuate segment 2002 of a greater radius having a plurality of apertures 2004 that receives a plurality of screws 2006 to fasten a round plate 2008 to the arcuate segment 2002. The round decorative graphic 1606, 1828 is affixed to the round plate 2008. The mounting bracket 1608, 1830 is fastened to the generally cylindrical bracket 1604, 1826 opposite the arcuate segment 2002. The aperture 1610, 1832 of mounting bracket 1608, 1830 receives and holds the interchangeable decorative graphic 1612, 1834. The mounting bracket 1608, 1830 also includes a mounting flange 2010 configured to fasten the bracket assembly 1602, 1824 to the silhouette of a themed FIG. 130 or the three dimensional ornamental figure 128. The mounting flange 2010 includes an aperture 2012 at a first end 2014 and an aperture 2016 at a second end 2018. Apertures 2012, 2016 each receive a screw 2020, 2022, respectively, that thread into apertures on a back side of the silhouette of a themed FIG. 130 or the three dimensional ornamental figure 128, fastening the mounting bracket 1608, 1830 to the silhouette of a themed FIG. 130 or the three dimensional ornamental figure 128. The round decorative graphic 1606, 1828 and the round plate 2008 are round in this illustrated embodiment but in other embodiments the decorative graphic 1606, 1828 and the round plate 2008 can be of various shapes.

The third embodiment of the mounting bracket assembly 1624 of the first embodiment of the stool 100 or the third embodiment of the mounting bracket assembly 1726 of the second embodiment of the stool 502 is shown in detail in FIGS. 179-183. The generally cylindrical bracket 1626, 1728 includes an arcuate segment 2102 of a greater radius. The generally cylindrical bracket 1626, 1728 also includes a plurality of apertures 2104 that receive a plurality of screws 2106 to fasten bracket assembly 1624, 1726 to the mainframe shaft 114. The web-shaped arm 1628, 1730 laterally extends from the generally cylindrical bracket 1626, 1728, opposite the arcuate segment 2102, and converges at the distal end 1630, 1732. The distal end 1630, 1732 includes an aperture 2108 configured to fasten the bracket assembly 1624, 1726 to the silhouette of a themed FIG. 130 or the three dimensional ornamental figure 128.

The fifth embodiment of the mounting bracket assembly 1644 of the first embodiment of the stool 100 or the sixth embodiment of the mounting bracket assembly 1760 of the second embodiment of the stool 502 is shown in detail in FIGS. 184-189. The plurality of generally cylindrical brackets 1646, 1762 each includes an arcuate segment 2202 of a greater radius, each arcuate segment 2202 having at least one aperture 2204 that receives a screw 2206 to fasten a round plate 2208 to the arcuate segment 2202. The round decorative graphic 1647, 1764 is affixed to the round plate 2208. The plurality of generally cylindrical bracket 1646, 1762 also include a plurality of apertures 2210 that receive a plurality of screws 2212 to fasten bracket assembly 1624, 1726 to the mainframe shaft 114. The plurality of arms 1649, 1768 laterally extend from the plurality of generally cylindrical brackets 1646, 1762 and each include an aperture 2214 (not shown) at a distal end 2216 opposite the arcuate segment 2202. The mounting bracket 1648, 1766 is fastened to the distal end 2216 using screws 2218, in this illustrated embodiment, that thread into apertures 2214 of each arm 1649,1768. The mounting bracket 1648, 1766 also includes a plurality of apertures 2220 configured to receive screws 2222 to fasten the bracket assembly 1644, 1760 to the silhouette of a themed FIG. 130 or the three dimensional ornamental figure 128. The round decorative graphic 1647, 1764 and the round plate 2208 are round in this illustrated embodiment but in other embodiments the decorative graphic 1647, 1764 and the round plate 2208 can be of various shapes.

The seventh embodiment of the mounting bracket assembly 1656 of the first embodiment of the stool 100 or the tenth embodiment of the mounting bracket assembly 1792 of the second embodiment of the stool 502 is shown in detail in FIGS. 190-196. The cylindrical bracket 1658, 1794 includes the pair of opposing mounting flanges 1902 opposite the hinge 1668, 1804. Each end 2302, 2304 of the hinge 1668, 1804 includes at least one aperture 2306 that receives a screw 2308 to fasten a round plate 2310 to the ends 2302, 2304. The round decorative graphic 1660, 1796 is affixed to the round plate 2310. The cylindrical bracket 1658, 1794 also includes a plurality of apertures 2312 that receive a plurality of screws 2314 to fasten bracket assembly 1656, 1792 to the mainframe shaft 114. The pair of opposing mounting flanges 1902, opposite the hinge 1668, 1804 each include the plurality of apertures 1904 that each receive the screw 1906 and nut 1908 to further fasten the bracket assembly 1656, 1792 to the mainframe shaft 114. The pair of opposing mounting flanges 1902 also receive the shaft 1910 extending from the mounting bracket 1662, 1798, the mounting bracket 1662, 1798 rotatable about the shaft 1910 about Axis A (FIG. 196) as shown in FIG. 191. The aperture 1664, 1800 of mounting bracket 1662, 1798 receives and holds the interchangeable decorative graphic 1666, 1802. The mounting bracket 1662, 1798 includes the mounting flange 1912 configured to fasten the bracket assembly 1656, 1792 to the silhouette of a themed FIG. 130 or the three dimensional ornamental figure 128. The mounting flange 1912 also includes the aperture 1914 at the first end 1916 and the aperture 1918 at the second end 1920. Apertures 1914, 1918 each receive screws 1922, 1924 that thread into apertures 1926, 1928, respectively, on a back side of the silhouette of a themed FIG. 130 or the three dimensional ornamental figure 128, fastening the mounting bracket 1662, 1798 to the silhouette of a themed FIG. 130 or the three dimensional ornamental figure 128. The round decorative graphic 1660, 1796 and the round plate 2310 are round in this illustrated embodiment but in other embodiments the decorative graphic 1660, 1796 and the round plate 2310 can be of various shapes.

The fourth embodiment of the mounting bracket assembly 1632 of the first embodiment of the stool 100 or the fourth embodiment of the mounting bracket assembly 1734 of the second embodiment of the stool 502 is shown in detail in FIGS. 197-203. The cylindrical bracket 1634, 1736 includes a pair of opposing mounting flanges 2402 opposite the hinge 1642, 1746. Each end 2404, 2406 of the hinge 1642, 1763 includes at least one aperture 2408 that receives a screw 2410 to fasten a round plate 2412 to the ends 2404, 2406. The round decorative graphic 1636, 1738 is affixed to the round plate 2412. The cylindrical bracket 1634, 1736 also includes a plurality of apertures 2414 that receive a plurality of screws 2416 to fasten bracket assembly 1632, 1734 to the mainframe shaft 114. The pair of opposing mounting flanges 2402, opposite the hinge 1642, 1746 each include at least one aperture 2418 that each receive a screw 2420 and nut 2422 to further fasten the bracket assembly 1632, 1734 to the mainframe shaft 114 and fasten the mounting bracket 1638, 1740 to the generally cylindrical bracket 1634, 1736. The mounting bracket 1638, 1740 is rotatable about Axis A (FIGS. 197 & 198) as shown in FIG. 201. The aperture 1640, 1742 of mounting bracket 1638, 1740 receives and holds the interchangeable decorative graphic 1642, 1744. The mounting bracket 1638, 1740 includes the mounting flange 1912 configured to fasten the bracket assembly 1632, 1734 to the silhouette of a themed FIG. 130 or the three dimensional ornamental figure 128. The mounting flange 1912 also includes the aperture 1914 at the first end 1916 and the aperture 1918 at the second end 1920. Apertures 1914, 1918 each receive screws 1922, 1924 that thread into apertures 1926, 1928, respectively, on a back side of the silhouette of a themed FIG. 130 or the three dimensional ornamental FIG. 128, fastening the mounting bracket 1638, 1740 to the silhouette of a themed FIG. 130 or the three dimensional ornamental figure 128. The round decorative graphic 1636, 1738 and the round plate 2412 are round in this illustrated embodiment but in other embodiments the decorative graphic 1636, 1738 and the round plate 2412 can be of various shapes.

The ninth embodiment of the mounting bracket assembly 1676 of the first embodiment of the stool 100 or the fifth embodiment of the mounting bracket assembly 1748 of the second embodiment of the stool 502 is shown in detail in FIGS. 204-209. The top attachment bracket 1678, 1750 and the bottom attachment bracket 1680, 1752 each include a plurality of apertures 2502 that receive a plurality of screws 2504 that secure a plurality of magnetic washers 2506 to the top attachment bracket 1678, 1750 and the bottom attachment bracket 1680, 1752 with a plurality of nuts 2508. The plurality of magnetic washers 2506 fasten bracket assembly 1676, 1748 to the mainframe shaft 114. The laterally extending shaft 1684, 1756 receives a screw 2510 through an upper aperture 2512 of the mounting bracket 1682, 1754 to fasten the mounting bracket 1682, 1754 to the top attachment bracket 1678, 1750 and the laterally extending shaft 1686, 1758 receives a screw 2514 through a lower aperture 2516 of the mounting bracket 1682, 1754 to fasten the mounting bracket 1682, 1754 to the bottom attachment bracket 1680, 1752. The mounting bracket 1682, 1754 also includes a plurality of apertures 2518 that each receive screws 2520 that fasten the mounting bracket 1682, 1754 to the silhouette of a themed FIG. 130 or the three dimensional ornamental figure 128.

The tenth embodiment of the mounting bracket assembly 1688 of the first embodiment of the stool 100 or the seventh embodiment of the mounting bracket assembly 1770 of the second embodiment of the stool 502 is shown in detail in FIGS. 210-217. The attachment bracket 1690, 1772 includes a plurality of apertures 2602 that receive a plurality of screws 2604 that secure a plurality of magnetic washers 2606 to the attachment bracket 1690, 1772 with a plurality of nuts 2608. The plurality of magnetic washers 2606 fasten bracket assembly 1688, 1770 to the mainframe shaft 114. The laterally extending shaft 1694, 1776 includes a cylindrical or annular flange 2610, opposite that attachment bracket 1690, 1772, that receives a screw 2612 through an aperture 2614 of the mounting bracket 1692, 1774 to fasten the mounting bracket 1692, 1774 to the attachment bracket 1690, 1772. The mounting bracket 1692, 1774 is rotatable about the shaft 1694, 1776 about Axis A (FIG. 217) as shown in FIG. 211. The mounting bracket 1692, 1774 also includes a plurality of apertures 2616 that each receive screws 2618 that fasten the mounting bracket 1692, 1774 to the silhouette of a themed FIG. 130 or the three dimensional ornamental figure 128.

The second embodiment of the mounting bracket assembly 1614 of the first embodiment of the stool 100 or the eleventh embodiment of the mounting bracket assembly 1806 of the second embodiment of the stool 502 is shown in detail in FIGS. 218-223. The generally cylindrical bracket 1616, 1808 includes an arcuate segment 2702 of a greater radius having a plurality of apertures 2704 that receives a plurality of screws 2706 (not shown) to fasten the bracket assembly 1614, 1806 to the mainframe shaft 114. The generally cylindrical bracket 1616, 1808 also includes a plurality of apertures 2708 that receive a plurality of screws 2710 to further fasten bracket assembly 1614, 1806 to the mainframe shaft 114. The mounting bracket 1618, 1810 is fastened to the generally cylindrical bracket 1616, 1808 opposite the arcuate segment 2702. The aperture 1620, 1812 of mounting bracket 1618, 1810 receives and holds the interchangeable decorative graphic 1622, 1814 (not shown). The mounting bracket 1618, 1810 also includes a mounting flange 2712 configured to fasten the bracket assembly 1614, 1806 to the silhouette of a themed FIG. 130 or the three dimensional ornamental figure 128. The mounting flange 2712 includes an aperture 2714 at a first end 2716 and an aperture 2718 at a second end 2720. Apertures 2714, 2718 each receive a screw 2722, 2724, respectively, that thread into apertures on a back side of the silhouette of a themed FIG. 130 or the three dimensional ornamental figure 128, fastening the mounting bracket 1618, 1810 to the silhouette of a themed FIG. 130 or the three dimensional ornamental figure 128.

The sixth embodiment of the mounting bracket assembly 1650 of the first embodiment of the stool 100 or the twelfth embodiment of the mounting bracket assembly 1816 of the second embodiment of the stool 502 is shown in detail in FIGS. 224-229. The plurality of generally cylindrical brackets 1652, 1818 each include an arcuate segment 2802 of a greater radius having at least one aperture 2804 that each receives a screw 2806 to fasten the bracket assembly 1650, 1816 to the mainframe shaft 114. The plurality of generally cylindrical brackets 1652, 1818 also include a plurality of apertures 2808 that receive a plurality of screws 2810 to further fasten bracket assembly 1650, 1816 to the mainframe shaft 114. Each of the plurality of arms 1655, 1822 receives a screw 2812 through an aperture 2814, 2816 of the mounting bracket 1654, 1820 to fasten the mounting bracket 1654, 1820 to the plurality of generally cylindrical brackets 1652, 1818. The mounting bracket 1654, 1820 also includes a plurality of apertures 2818 that each receive screws 2820 to fasten the mounting bracket 1654, 1820 to the silhouette of a themed FIG. 130 or the three dimensional ornamental figure 128.

The eighth embodiment of the mounting bracket assembly 1670 of the first embodiment of the stool 100 or the ninth embodiment of the mounting bracket assembly 1786 of the second embodiment of the stool 502 is shown in detail in FIGS. 230-236. The plurality of generally cylindrical brackets 1672, 1788 each include an arcuate segment 2902 of a greater radius, each arcuate segment 2902 having at least one aperture 2904 that receives a screw 2906 to fasten a round plate 2908 to the arcuate segment 2902. The round decorative graphic 1674, 1790 is affixed to the round plate 2908. The plurality of generally cylindrical bracket 1672, 1788 also include a plurality of apertures 2910 that receive a plurality of screws 2912 to fasten bracket assembly 1670, 1786 to the mainframe shaft 114. The round decorative graphic 1674, 1790 and the round plate 2908 are round in this illustrated embodiment but in other embodiments the decorative graphic 1674, 1790 and the round plate 2908 can be of various shapes.

A fourteenth embodiment of a mounting bracket assembly 3002 of the first embodiment of the stool 100 or the second embodiment of the stool 502 is shown in detail in FIGS. 237-243. The mounting bracket assembly 3002 comprises an annular or cylindrical bracket 3004 configured to be secured around mainframe shaft 114, a round decorative graphic 3006 on a side opposite the silhouette of a themed figure and/or the three dimensional ornamental figure 128, and a mounting bracket 3008 configured to secure the bracket assembly 3002 to the silhouette of a themed figure and/or the three dimensional ornamental figure 128, the mounting bracket 3008 including an aperture 3010 that holds an interchangeable decorative graphic 3012 on a side adjacent the silhouette of a themed figure and/or the three dimensional ornamental figure 128. The cylindrical bracket 3004 includes a mounting flange 3014 opposite the mounting bracket 3008 that includes a plurality of apertures 3016. Each aperture 3016 receives a screw 3018 to fasten a round plate 3020 to the mounting flange 3014. The round plate 3020 includes a plurality of apertures 3022 that receive screws 3024 to affix the round decorative graphic 3006 to the round plate 3020. The cylindrical bracket 3004 also includes a plurality of apertures 3026 that receive a plurality of screws 3028 to fasten bracket assembly 3002 to the mainframe shaft 114. The mounting bracket 3008 is secured to the cylindrical bracket 3004 through welding, braising, or other attachment means as are known in the art. The mounting bracket 3008 comprises a mounting flange 3030 that includes an aperture 3032 at a first end 3034 and an aperture 3036 at a second end 3038. Apertures 3032, 3036 each receive screws 3040, 3042, respectively, that fasten the mounting bracket 3008 to the silhouette of a themed FIG. 130 or the three dimensional ornamental figure 128. The round decorative graphic 3006 and the round plate 3020 are round in this illustrated embodiment but in other embodiments the decorative graphic 3006 and the round plate 3020 can be of various shapes.

The second embodiment of the mounting bracket assembly 1716 of the second embodiment of the stool 502 is shown in detail in FIGS. 244-249. The cylindrical bracket 1718 includes a plurality of apertures 3102 that receive a plurality of screws 3104 to fasten bracket assembly 1716 to the mainframe shaft 114. The mounting bracket 1720 is fastened to the cylindrical bracket 1718 through welding, braising, or other attachment means as are known in the art. The aperture 1722 of mounting bracket 1720 receives and holds the interchangeable decorative graphic 1724 (not shown). The mounting bracket 1720 also includes a mounting flange 3106 configured to fasten the bracket assembly 1716 to the silhouette of a themed FIG. 130 or the three dimensional ornamental figure 128. The mounting flange 3106 includes an aperture 3108 at a first end 3110 and an aperture 3112 at a second end 3114. Apertures 3108, 3112 each receive a screw 3116, 3118, respectively, that fasten the mounting bracket 1720 to the silhouette of a themed FIG. 130 or the three dimensional ornamental figure 128.

The eighth embodiment of the mounting bracket assembly 1778 of the second embodiment of the stool 502 is shown in detail in FIGS. 250-255. The plurality of cylindrical brackets 1780 each include a plurality of apertures 3202 that receive a plurality of screws 3204 to fasten bracket assembly 1778 to the mainframe shaft 114. Each of the plurality of web-shaped arms 1784 receives a screw 3206 through an aperture 3208, 3210 of the mounting bracket 1782 to fasten the mounting bracket 1782 to the plurality of generally cylindrical brackets 1780. The mounting bracket 1782 also includes a plurality of apertures 3212 that each receive screws 3214 to fasten the mounting bracket 1782 to the silhouette of a themed FIG. 130 or the three dimensional ornamental figure 128.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A stool comprising:
a seat;
a mainframe component adapted to support the seat;
an inner shaft disposed within the mainframe component;
a lower shaft adapted to receive a distal end of the inner shaft;
a base removably attached to the lower shaft,
at least one of a three dimensional ornamental figure, a silhouette of a themed figure, and a decorative graphic removably attached to the mainframe component, and
a mounting bracket assembly removably attached to one of the three dimensional ornamental figure, a silhouette of a themed figure, and a decorative graphic to the mainframe component.

2. The stool of claim 1, wherein the mounting bracket assembly includes one of at least one arcuate attachment bracket and at least one cylindrical attachment bracket, the attachment bracket adapted to removably attach the mounting bracket assembly to the mainframe component.

3. The stool of claim 2, wherein the mounting bracket assembly includes a mounting bracket mounted to one of the at least one arcuate attachment bracket and the at least one cylindrical attachment bracket, the mounting bracket adapted to removably attach the mounting bracket assembly to one of the three dimensional ornamental figure, a silhouette of a themed figure, and a decorative graphic to the mainframe component.

4. The stool of claim 3, wherein the mounting bracket includes an aperture adapted to receive a removably decorative graphic.

5. The stool of claim 2, wherein the mounting bracket is rotatable.

6. The stool of claim 2, wherein the mounting bracket assembly includes a plate removably attached to one of the at least one arcuate attachment bracket and the at least one cylindrical attachment bracket, the plate adapted to receive a removably decorative graphic.

7. The stool of claim 1, wherein the mounting bracket assembly includes at least one attachment bracket adapted to removably attach the mounting bracket assembly to the mainframe component.

8. The stool of claim 7, wherein the attachment bracket includes at least one magnet adapted to removably attach the attachment bracket to the mainframe component.

9. The stool of claim 7, wherein the mounting bracket assembly includes a mounting bracket mounted to the at least one attachment bracket, the mounting bracket adapted to removably attach the mounting bracket assembly to one of the three dimensional ornamental figure, a silhouette of a themed figure, and a decorative graphic to the mainframe component.

10. The stool of claim 9, wherein the mounting bracket is rotatable.

11. A stool comprising:
a seat;
a mainframe component adapted to support the seat;
an inner shaft disposed within the mainframe component;
a lower shaft adapted to receive a distal end of the inner shaft;
a base removably attached to the lower shaft;
a planar mounting surface at a forward end of the mainframe component, the planar mounting removably attached to the seat;
a mainframe shaft subjacent to the planar mounting surface;
a foot support component laterally extending from a distal end of the mainframe shaft, and
a lever mechanism laterally extending from the mainframe shaft subjacent to the planar mounting surface, the lever mechanism adapted to vertically adjust the seat.

12. The stool of claim 11, further comprising:
a cylindrical plunger at an upper end of the inner shaft, wherein the lever mechanism is adapted to at least one of apply and release pressure to the cylindrical plunger causing the inner shaft to at least one of descend and ascend within the lower shaft.

13. The stool of claim 11, further comprising:
an attachment bracket removably attached to the distal end of the mainframe shaft;
a cantilever arm laterally extending from the attachment bracket; and
an arcuate foot support arm mounted to a distal end of the cantilever arm.

14. The stool of claim 13, further comprising:
a plug at each end of the foot support arm; and
a bushing at the distal end of the mainframe component.

15. A stool comprising:
a seat;
a mainframe component adapted to support the seat;
an inner shaft disposed within the mainframe component;
a lower shaft adapted to receive a distal end of the inner shaft;
a base removably attached to the lower shaft;
a decorative graphic removably attached to the removable base; and
an aperture adapted to removably engage a distal end of the lower shaft.

16. A stool comprising:
a seat;
a mainframe component adapted to support the seat;
an inner shaft disposed within the mainframe component;
a lower shaft adapted to receive a distal end of the inner shaft;
a base removably attached to the lower shaft;
a back support vertically extending from a seat support of the seat, the back support comprising a panel adapted to receive a decorative graphic; and one of a translucent and transparent cover disposed in the panel, the cover adapted to protect the decorative graphic.

17. A stool comprising:

a seat;

a mainframe component adapted to support the seat;

an inner shaft disposed within the mainframe component;

a lower shaft adapted to receive a distal end of the inner shaft;

a base removably attached to the lower shaft;

a light emitting diode (LED) printed circuit board (PCB) and a battery removably mounted on a bottom of the seat;

a cover removably attached to the bottom of the seat, the cover adapted to retain the LED PCB and the battery;

a panel removably attached to the cover; and a plurality of LED lights removably attached to the cover.

18. A mounting bracket assembly for removably attaching at least one of a decorative graphic and one ornamental figure to a shaft supporting a seat of a stool comprising:

one of at least one arcuate attachment bracket and at least one cylindrical attachment bracket adapted to removably attach to said shaft supporting the seat of the stool;

a mounting bracket fixedly attached to the attachment bracket, the mounting bracket adapted to be removably attached to said ornamental figure;

the mounting bracket having an aperture, the aperture adapted to hold and display a first interchangeable decorative graphic;

a second interchangeable decorative graphic removably attached to and displayed from the one of the at least one arcuate attachment bracket and the at least one cylindrical attachment bracket.

19. The mounting bracket assembly of claim 18, wherein:

the one ornamental figure is one of a football helmet ornamental figure, a baseball catcher helmet ornamental figure, a racing helmet ornamental figure, a motorcycle helmet ornamental figure, a hockey goalie helmet ornamental figure, a basketball and hoop ornamental figure, a beverage can ornamental figure, and a beverage bottle ornamental figure.

20. The mounting bracket assembly of claim 18, wherein the mounting bracket assembly includes a plate removably attached to one of the at least one arcuate attachment bracket and the at least one cylindrical attachment bracket, the plate adapted to receive said second interchangeable decorative graphic.

* * * * *